US006577289B1

(12) United States Patent
Asao et al.

(10) Patent No.: US 6,577,289 B1
(45) Date of Patent: Jun. 10, 2003

(54) LIQUID CRYSTAL DEVICE AND DISPLAY APPARATUS INCLUDING THE DEVICE

(75) Inventors: Yasufumi Asao, Atsugi (JP); Masahiro Terada, Hadano (JP); Takeshi Togano, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/534,447

(22) Filed: Mar. 24, 2000

(30) Foreign Application Priority Data

Mar. 26, 1999 (JP) ..... 11-083034
Mar. 26, 1999 (JP) ..... 11-083713

(51) Int. Cl.[7] ..... G09G 3/36
(52) U.S. Cl. ..... 345/87; 345/97; 349/134
(58) Field of Search ..... 345/27, 204, 50, 345/87, 54, 96; 349/133, 134; 252/299.01

(56) References Cited

U.S. PATENT DOCUMENTS 4,367,924 A 1/1983 Clark et al. ..... 350/334
4,932,758 A * 6/1990 Hanyu et al. ..... 349/133
5,458,804 A 10/1995 Yamada et al. ..... 252/299.01
5,629,788 A 5/1997 Mori et al. ..... 349/172
6,083,574 A * 7/2000 Asao et al. ..... 252/299.01
6,323,850 B1 * 11/2001 Katakura et al. ..... 345/204

FOREIGN PATENT DOCUMENTS

JP 56-107216 8/1981

OTHER PUBLICATIONS

Applied Physics Letters, vol. 19, No. 4, Feb. 1971, pp. 127–128.
Marc D. Radcliffe, 3M Company, P–46, pp. 169–170.

* cited by examiner

*Primary Examiner*—Dennis-Doon Chow
(74) *Attorney, Agent, or Firm*—Fitzpatrick, Cella, Harper & Scinto

(57) ABSTRACT

A liquid crystal device comprises chiral smectic liquid crystal, two substrates and electrodes for applying a voltage to the liquid crystal to form pixels, each provided with an active element connected to an associated electrode on at least one substrate. The liquid crystal alignment forms domains D1 and D2, wherein the liquid crystal is aligned to provide an average molecular axis in a monostable alignment state under no voltage application, is tilted from such state in one direction when supplied with a voltage of a first polarity at a tilting angle which varies with the magnitude of the supplied voltage, and is tilted in the other direction when supplied with a voltage of a second and opposite polarity. Maximum tilting angles $\beta 1$ and $\beta 2$, formed under application of the voltages of the first and second polarities, respectively, satisfy: $\beta 1 > \beta 2 > 0$ in domain D1 and $0 < \beta 1 < \beta 2$ in domain D2.

11 Claims, 12 Drawing Sheets

C1 ALIGNMENT

C2 ALIGNMENT

C1 ALIGNMENT

C2 ALIGNMENT

C1 ALIGNMENT

C2 ALIGNMENT

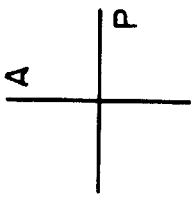
FIG. 6D
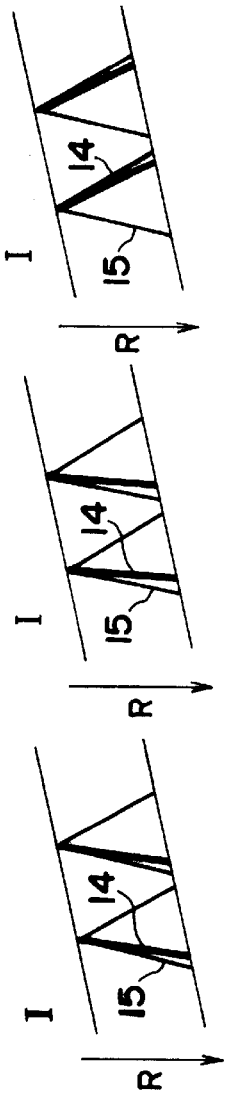
FIG. 6AA
FIG. 6BA
FIG. 6CA
FIG. 6AB
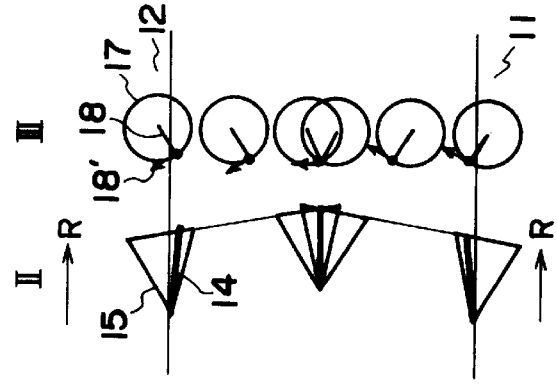
FIG. 6BB
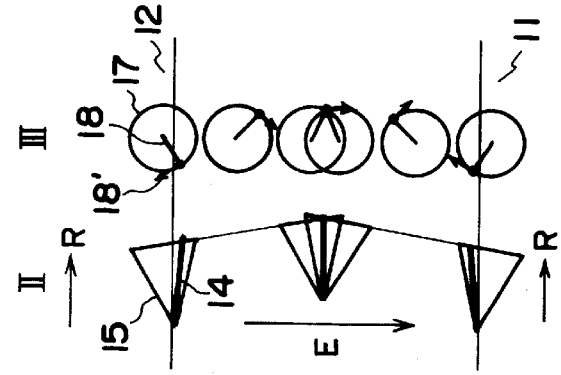
FIG. 6CB

LIQUID CRYSTAL DEVICE AND DISPLAY APPARATUS INCLUDING THE DEVICE

BACKGROUND OF THE INVENTION

The present invention relates to a liquid crystal device for use in flat-panel displays, projection displays, printers, etc., and a liquid crystal apparatus including the liquid crystal device.

As a type of nematic liquid crystal display device used heretofore, there has been known an active matrix-type liquid crystal device wherein each pixel is provided with an active element (e.g., a thin film transistor (TFT)).

As a nematic liquid crystal material used for such an active matrix-type liquid crystal device using a TFT, there has been presently widely used a twisted nematic (TN) liquid crystal as disclosed by M. Schadt and W. Helfrich, Appl. Phys. Lett., vol. 18, no. 4, pp. 127–128 (1971).

In recent years, there has been proposed an In-Plain Switching mode of liquid crystal device utilizing an electric field applied in a longitudinal direction of the device, thus improving a viewing angle characteristic which is problematic in TN-mode liquid crystal displays. Further, a liquid crystal device of a super twisted nematic (STN) mode without using the active element (TFT. etc.) has also been known as a representative example of the nematic liquid crystal display device.

Accordingly, the nematic liquid crystal display device includes various display or drive modes. In any mode, however, the resultant nematic liquid crystal display device has encountered a problematic slow response speed of several ten milliseconds or above.

In order to solve the above-mentioned difficulties of the conventional types of nematic liquid crystal devices, a liquid crystal device using a liquid crystal exhibiting bistability ("SSFLC", Surface Stabilized FLC) has been proposed by Clark and Lagerwall (Japanese Laid-Open Patent Application (JP-A) 56-107216, U.S. Pat. No. 4,367,924). As the liquid crystal exhibiting bistability, a chiral smectic liquid crystal or a ferroelectric liquid crystal (FLC) having chiral smectic C phase (SmC*) is generally used. Such a chiral smectic (ferroelectric) liquid crystal has a very quick response speed, because it causes inversion switching of liquid crystal molecules by the action of an applied electric field on spontaneous polarizations of their liquid crystal molecules. Accordingly, the chiral smectic liquid crystal is considered suitable for constituting a display device or a light valve of a high speed. Further, the liquid crystal device using the chiral smectic liquid crystal generally effects light transmission by utilizing birefringence to provide a bright state, thus realizing a relatively wide viewing angle characteristic.

In recent years, as another liquid crystal material, an anti ferroelectric liquid crystal showing tristability (tristable states) has caught attention. Similarly to the ferroelectric liquid crystal, the anti ferroelectric liquid crystal causes molecular inversion switching based on the action of an applied electric field on its spontaneous polarization, thus providing very highspeed responsiveness. This type of liquid crystal material has a molecular alignment (orientation) structure wherein liquid crystal molecules cancel or counterbalance each others' spontaneous polarizations under no electric field application, thus having no spontaneous polarization in the absence of the electric field.

The above-mentioned ferroelectric and anti ferroelectric liquid crystal causing inversion switching based on spontaneous polarization are liquid crystal materials assuming smectic phase (chiral smectic liquid crystals). Accordingly, by using these liquid crystal materials capable of solving the problem of the conventional nematic liquid crystal materials in terms of response speed, it has been expected to realize a smectic liquid crystal display device.

As described above, the (anti-)ferroelectric (or chiral smectic) liquid crystal having a spontaneous polarization has been expected to be suitable for use in displays exhibiting highspeed response performance in the near future.

In the case of the above-mentioned device (cell) using the (anti-)ferroelectric liquid crystal exhibiting bistability or tristability, however, it has been difficult to effect a gradation display in each pixel due to its display principle.

In recent years, in order to allow a mode of controlling various gradation levels, there have been proposed liquid crystal devices using a specific chiral smectic liquid crystal, such as a ferroelectric liquid crystal of a short pitch-type, a polymer-stabilized ferroelectric liquid crystal or an anti-ferroelectric liquid crystal showing no threshold (voltage) value. However, these devices have not been put into practical use sufficiently.

Our research group has proposed a liquid crystal device using a chiral smectic liquid crystal having a phase transition series on temperature decrease of Iso (isotropic phase)–Ch (cholesteric phase)–SmC* (chiral smectic C phase) or Iso–SmC* (U.S. patent application Ser. No. 09/338,426 filed Jun. 23, 1999). The chiral smectic liquid crystal device has provided practical advantages in terms of highspeed responsiveness, massproductivity, etc.

Specifically, when the chiral smectic liquid crystal having the phase transition series of Iso–Ch–SmC* or Ch–SmC* on temperature decrease is disposed in a uniaxial aligned cell, liquid crystal molecules are oriented or aligned to provide a smectic layer normal direction (a direction of a normal to smectic molecular layers) deviating from the uniaxial aligning treatment (axis) direction. By controlling the deviating layer normal direction of smectic liquid crystal molecules in one direction, the liquid crystal molecules are aligned in a direction such that a molecular position corresponding to only one of two stable states in SmC* present in parallel with substrates substantially coincides with the uniaxial aligning treatment (axis) direction, thus monostabilizing the liquid crystal molecules in one direction. As a result, the liquid crystal molecules can assume an intermediate light-transmission state depending on a voltage applied thereto while retaining a highspeed responsiveness.

Such a liquid crystal device, however, provides different display characteristics such that a relatively bright display state is obtained depending on an applied voltage of one polarity and a relatively dark display state is obtained under application of an applied voltage of the other polarity when driven using an AC driving waveform. As a result, even in the case of setting a frame frequency of an input picture (image) signal to 60 Hz, an actual frame frequency for gradational display becomes 30 Hz, thus causing a remarkable flickering.

Further, the liquid crystal device has a poor viewing angle characteristic such that a white color tone changes from a desired level when viewed from a side or oblique direction. This is attributable to different retardations (optical path difference) between a retardation in a long molecular axis direction and a retardation in a short molecular axis direction when the liquid crystal device is observed from its oblique direction, since a bright state is given by light transmission based on the birefringence effect. When a viewing angle is closer to the long axis direction of liquid crystal molecules, a resultant refractive index anisotropy (birefringence) is liable to change compared with the case where the viewing angle is in other directions, thus being liable to change or invert a gradational level and color tone in the long molecular axis direction. On the other hand, in the short molecular axis direction perpendicular to the long molecular axis direction, the resultant refractive index anisotropy is not changed, but the optical path is increased with a tilting (inclination) of the viewing angle. As a result, white color tone is shifted toward a yellowish tint in the short molecular axis direction.

SUMMARY OF THE INVENTION

In view of the above-mentioned problems, an object of the present invention is to provide a liquid crystal device and a liquid crystal apparatus including the liquid crystal device capable of effecting clear gradational image display with a high gradation reproducibility while suppressing an occurrence of flickering.

Another object of the present invention is to provide a liquid crystal device and a liquid crystal apparatus using the liquid crystal device capable of suppressing a change in color tone when viewed from its oblique direction to improve a viewing angle-dependent color tone characteristic while retaining a clear motion picture display performance.

According to the present invention, there is provided a liquid crystal device comprising a chiral smectic liquid crystal, a pair of substrates disposed to sandwich the liquid crystal and having thereon electrodes for applying a voltage to the liquid crystal so as to form a plurality of pixels, each provided with an active element connected to an associated electrode on at least one of the substrate wherein the liquid crystal is aligned to form domains D1 and D2 having mutually different directions of normal to smectic layers, and the liquid crystal has an alignment characteristic in each of the domains D1 and D2 such that the liquid crystal is aligned to provide an average molecular axis to be placed in a monostable alignment state under no voltage application, is tilted from the monostable alignment state in one direction when supplied with a voltage of a first polarity at a tilting angle which varies depending on the magnitude of the supplied voltage, and is tilted from the monostable alignment state in the other direction when supplied with a voltage of a second polarity opposite to the first polarity at a tilting angle, said tilting angles providing maximum tilting angles $\beta 1$ and $\beta 2$ formed under application of the voltages of the first and second polarities, respectively, satisfying:

$$\beta 1 > \beta 2 > 0 \text{ in domain } D1,$$

and $$0 < \beta 1 < \beta 2 \text{ in domain } D2.$$

According to the present invention, there is also provided a liquid crystal display apparatus comprising the liquid crystal device and drive means for driving the active elements of the liquid crystal device.

These and other objects, features and advantages of the present invention will become more apparent upon consideration of the following description of the preferred embodiments of the present invention taken in conjunction with the accompanying drawings.

BRIEF DESCRIPTION OF THE DRAWINGS

FIGS. 4A, 4BA, 4BB, 4CA and 4CB are illustrations of alignment states of liquid crystal molecules in an embodiment of a liquid crystal device used in the present invention, wherein FIG. 4A shows a course of smectic layer formation of liquid crystal molecules exhibiting a phase transition series of Ch–SmC* in a chevron structure or an oblique bookshelf structure, FIGS. 4BA and 4CA are plan views showing alignment states of liquid crystal molecules having a chevron structure in a C1 alignment and a C2 alignment, respectively, and FIGS. 4BB and 4CB are corresponding positions of liquid crystal molecules and C-directors in the alignment states shown in FIGS. 4BA and 4CA, respectively.

FIGS. 6AA, 6AB, 6BA, 6BB, 6CA, 6CB and 6D are schematic views showing a liquid crystal inversion behavior in chiral smectic C phase under voltage application in an embodiment of a liquid crystal device used in the present invention, wherein FIGS. 6AA, 6BA and 6CA are plan views showing alignment states of liquid crystal molecules in C2 alignment; FIGS. 6AB, 6BB and 6CB are corresponding positions of liquid crystal molecules and C-directors in the alignment states shown in FIGS. 6AA, 6BA and 6CA, respectively; and FIG. 6D illustrates an arrangement of a pair of polarizers.

DESCRIPTION OF THE PREFERRED EMBODIMENTS

Hereinbelow, some preferred embodiments of the liquid crystal device and apparatus according to the present invention will be described specifically with reference to the drawings.

First Embodiment

In an active matrix-type liquid crystal device used in the present invention according to this embodiment, different domains D1 and D2 providing different smectic layer normal directions are co-present pixel by pixel.

Figure 15:
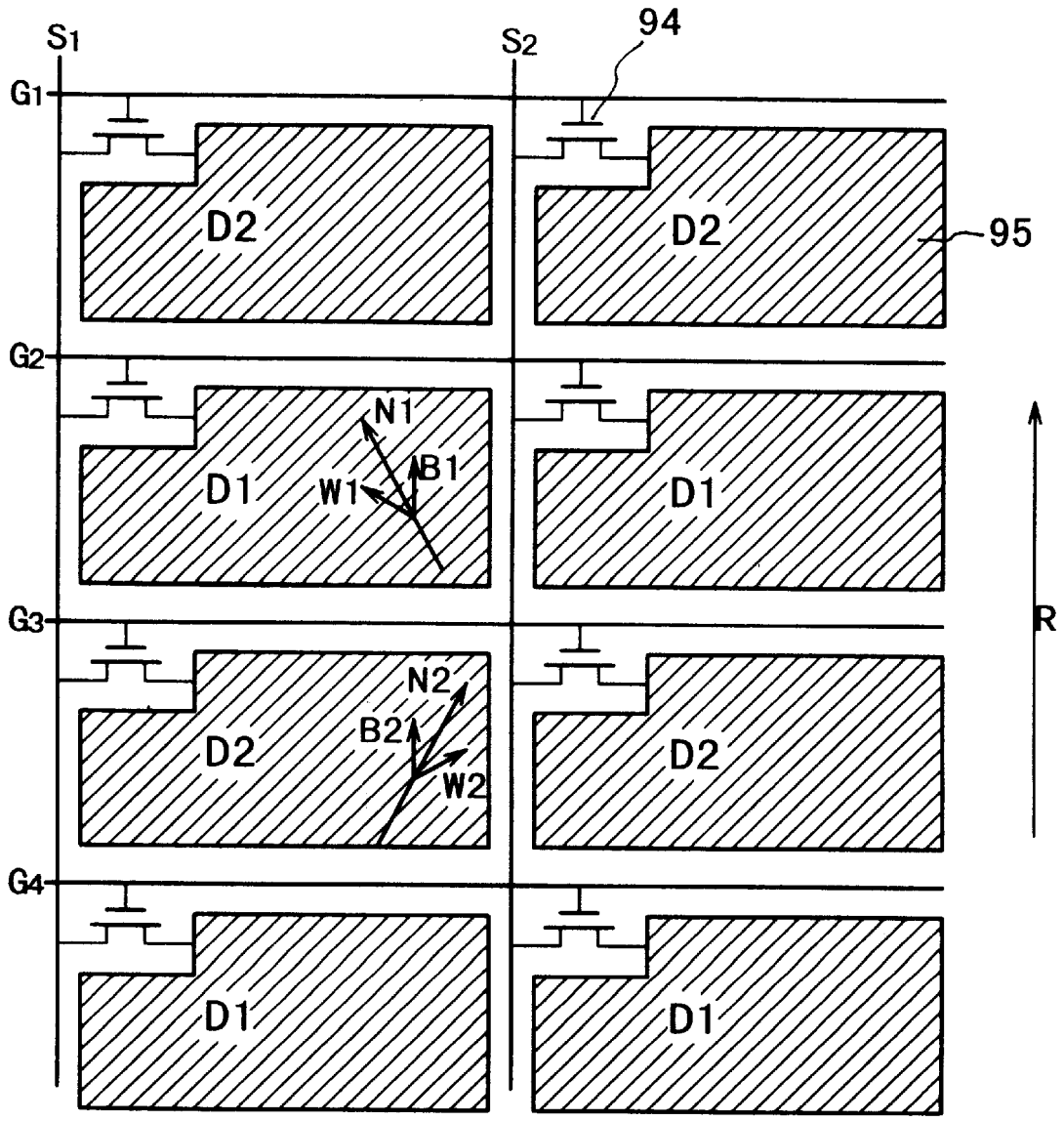
FIGS. 15 and 16 are respectively plan views of embodiments of the active matrix-type liquid crystal device according to the present invention for illustrating an arrangement of different domains D1 and D2 pixel by pixel.

FIG. 15 shows a plan view of such an active matrix-type liquid crystal device wherein gate lines G1, G2, . . . and source lines S1, S2, . . . intersect each other to form a plurality of pixels, each provided with a pixel electrode 95 connected to an active element (e.g., TFT) 94, at each intersection of the gate and source lines. The liquid crystal device is provided with a uniaxial aligning treatment axis (rubbing axis) in a direction of an arrow R.

Referring to FIG. 15, a first domain D1 and a second domain D2 are alternately present for each gate line. Specifically, the first domain D1 is formed at pixels on even gate lines G2, G4, . . . , and the second domain D2 is formed at pixels on odd gate lines G1, G3, . . . as shown in FIG. 15.

A layer normal direction Ni in the first domain D1 is different from a layer normal direction N2 in the second domain D2, and both the layer normal directions N1 and N2 are not aligned with the rubbing direction R.

In each first domain D1, a dark (black) molecular position B1 deviates from the layer normal direction N1 in a clockwise direction, and a bright (white) molecular position W1 deviates from the layer normal direction N1 in a counterclockwise direction.

On the other hand, in each second domain D2, a dark molecular position B2 and a bright molecular position W2 deviate from the layer normal direction N2 in a counterclockwise direction and a clockwise direction, respectively, i.e., in an opposite relationship to those in the first domain D1, respectively.

An average molecular axis direction at the dark molecular position B1 and that at the dark molecular position B2, respectively, deviate somewhat from the rubbing direction R.

Herein, the clockwise direction corresponds to a tilting direction of liquid crystal molecules under application of a positive polarity (+) voltage, and the counterclockwise direction corresponds to that under application of a negative polarity (−) voltage, respectively.

Accordingly, in the first domain D1, the liquid crystal molecules are tilted from the layer normal direction N1 toward the dark molecular position B1 by the positive polarity voltage application and toward the bright molecular position W1 by the negative polarity voltage application. In contrast thereto, in the second domain D2, the liquid crystal molecules are tilted from the layer normal direction N2 toward the dark and bright molecular positions B2 and W2 by the application of the negative and positive polarity voltages, respectively.

When the liquid crystal device is driven according to a frame inversion driving scheme (a driving scheme wherein a polarity of an applied voltage is alternately changed in every frame period) in a frame period under the positive polarity voltage application, the liquid crystal molecules in the first domain D1 sufficiently respond t the positive polarity voltage application, but are tilted in the second domain D2 at a tilting angle (from the layer normal direction N2) which is several to several ten times smaller than a tilting angle in the first domain D1. On the other hand, in a frame period under the negative polarity voltage application, the liquid crystal molecules in the second domain D2 sufficiently respond to the negative polarity voltage application, but are tilted in the first domain D1 at a tilting angle (from the layer normal direction N1) which is several to several ten times smaller than a tilting angle in the second domain D2. As a result, the liquid crystal molecules at pixels on the even gate lines (G2, G4, . . . ) principally respond sufficiently in the positive polarity voltage application frame period and those at pixels on the odd gate lines (G1, G3, . . . ) principally respond sufficiently in the negative polarity voltage application frame period, thus realizing display states substantially identical to those in the case of effecting driving of the liquid crystal according to a 1H inversion driving scheme (a driving scheme wherein a polarity of an applied voltage is alternately changed in every horizontal scanning period (1H) for scanning each gate line). As a result, it becomes possible to effectively suppress the flickering phenomenon.

Hereinbelow, a liquid crystal assuming chiral smectic phase suitably used in the liquid crystal device according to the present invention will be described in terms of an alignment state in chiral smectic phase and a switching behavior of its liquid crystal molecules by contrast with the above-mentioned conventional SSFLC with reference to FIGS. 1–8.

In FIGS. 1–8, the alignment state and switching behavior are explained based on typical molecular models representing relationships between liquid crystal molecules and a virtual cone (defining a position of liquid crystal molecules), a normal to a smectic (molecular) layer and an average uniaxial aligning treatment axis. The liquid crystal molecules are present between a pair of substrates and twisted in a direction normal to the substrates. The behavior of the liquid crystal molecules is optically observed (e.g., through a polarizing microscope) as that of an average molecular axis. Accordingly, the average molecular axis defined in the present invention corresponds to a single liquid crystal molecule.

In the conventional SSFLC-type device using a liquid crystal assuming chiral smectic C phase (SmC*), liquid crystal molecules are stabilized in (either one of) two (optically) stable states, thus developing a bistability or a memory characteristic. First, this memory state will be described with reference to FIGS. 1 and 2.

Figure 1A:
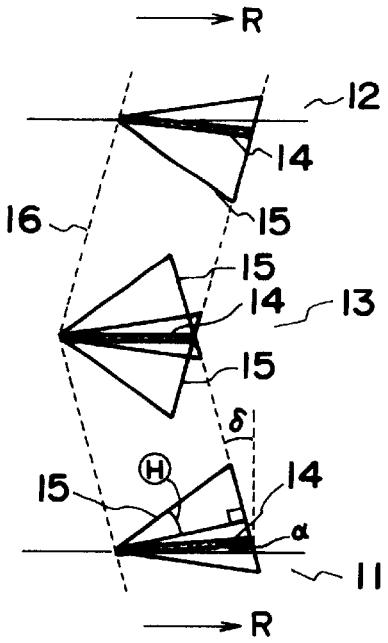
FIGS. 1A an 1B are illustrations of liquid crystal molecules and a smectic layer structure formed thereby in C1 alignment and C2 alignment, respectively, in an SSFLC-type device.
Figure 1B:
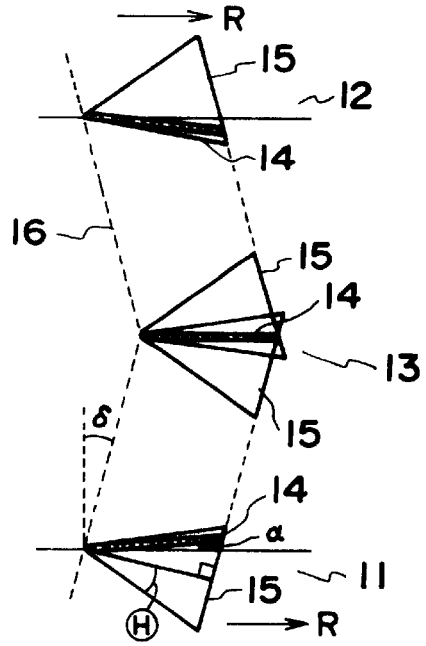

FIGS. 1A and 1B are schematic illustrations of liquid crystal molecules and a smectic (molecular) layer structure formed thereby in the SSFLC-type device.

Referring to FIGS. 1A and 1B, a liquid crystal 13 sandwiched between a pair of parallel substrates 11 and 12 includes a plurality of liquid crystal molecules 14. The liquid crystal molecules 14 in the vicinity of boundaries with the substrates form a pretilt angle $\alpha$, the direction of which is such that the liquid crystal molecules 14 raise a forward end up (i.e., spaced from the substrate surface) in the directions of uniaxial aligning treatment indicated by arrows R, respectively. In these figures, the uniaxial aligning treatment axis directions R of the pair of substrates 11 and 12 are parallel to each other and in an identical direction. Between the pair of substrates 11 and 12, the liquid crystal molecules 14 form each smectic (molecular) layer 16 having a chevron structure where the smectic layer 16 is bent at a mid point between the substrates (hereinbelow, referred to as a "bending point") and provides a layer inclination angle $\delta$ with respect to a normal to the substrates. These liquid crystal molecules 14 cause switching between two stable states under electric field application and under no electric field application, are stably present at a wall surface (side line) of a virtual cone 15 having an apex angle 2Ⓗ (Ⓗ: a tilt or cone angle intrinsic to the liquid crystal material used).

As shown in FIGS. 1A an 1B, the liquid crystal 13 between the substrates 11 and 12 can assume two different alignment states depending on the pretilt directions of the liquid crystal molecules 14 in the vicinity of the substrate surface and the bending directions of the chevron structures of the smectic layers 16 between the substrates 11 and 12. Herein, the alignment state shown in FIG. 1A is referred to as a "C1 alignment (state)" and the alignment state shown in FIG. 1B is referred to a "C2 alignment (state)", respectively.

In both the C1 and C2 alignment states, all the liquid crystal molecules 14 can assume two (optically) stable states within the cone 15 in a thickness direction between the substrates of the device including the bending points under no electric field application by generally satisfying a relationship of Ⓗ>δ, thus realizing bistable states.

Figure 2A:
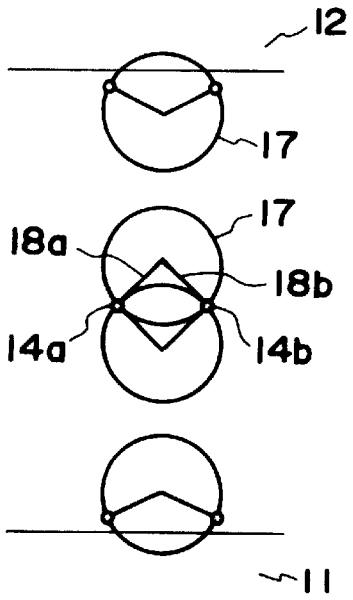
FIGS. 2A and 2B are illustrations of positions of C-directors in the C1 alignment shown in FIG. 1A and the C2 alignment shown in FIG. 1B, respectively.
Figure 2B:
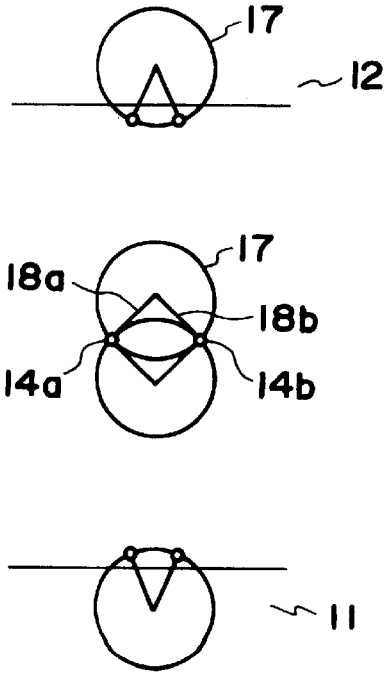

FIGS. 2A and 2B are views for illustrating positions of C-directors (projections of the liquid crystal molecules on a circular base 17 of the virtual cone 15) in the C1 alignment shown in FIG. 1A and the C2 alignment shown in FIG. 1B, respectively.

Referring to FIGS. 2A and 2B, each of the liquid crystal molecules may assume bistable states 14*a* and 14*b* (projections 18*a* and 18*b*) at any position between the substrates 11 and 12.

In the above (SSFLC-type) device wherein the liquid crystal assumes a bistability (bistable alignment states), a pair of (cross-nicol) polarizers are disposed so that one of the polarizing axes is aligned with one of two average molecular axes (molecular positions) providing the two (optically) stable states, thus effecting a switching between the two stable states (bistable states) to allow a black (dark) and white (bright) display. In this case, the switching (between the two stable states) is performed through formation of a domain of one of the two stable states from the other stable state, i.e., is accompanied with the formation and extinction of domain walls.

In the case of effecting display based on such a switching mechanism, the display is basically a two-value display providing a black display state and a white display state. Accordingly, it is difficult to effect a gradation (halftone) display between the black and white display states.

On the other hand, in the liquid crystal device according to the present invention, a liquid crystal material used is selected so that it does not exhibit the memory characteristic (bistability) as illustrated in FIGS. 1 and 2 and can continuously change its molecular position depending on a voltage applied thereto, in order to realize gradational display by the liquid crystal device using a liquid crystal material assuming chiral smectic phase. For this reason, in the present invention, the liquid crystal material used may preferably be a liquid crystal material exhibiting a phase transition series of Iso. (isotropic liquid phase)–Ch (cholesteric phase)–SmC* (chiral smectic C phase) or of Iso.–SmC* on temperature decrease.

Figure 3A:
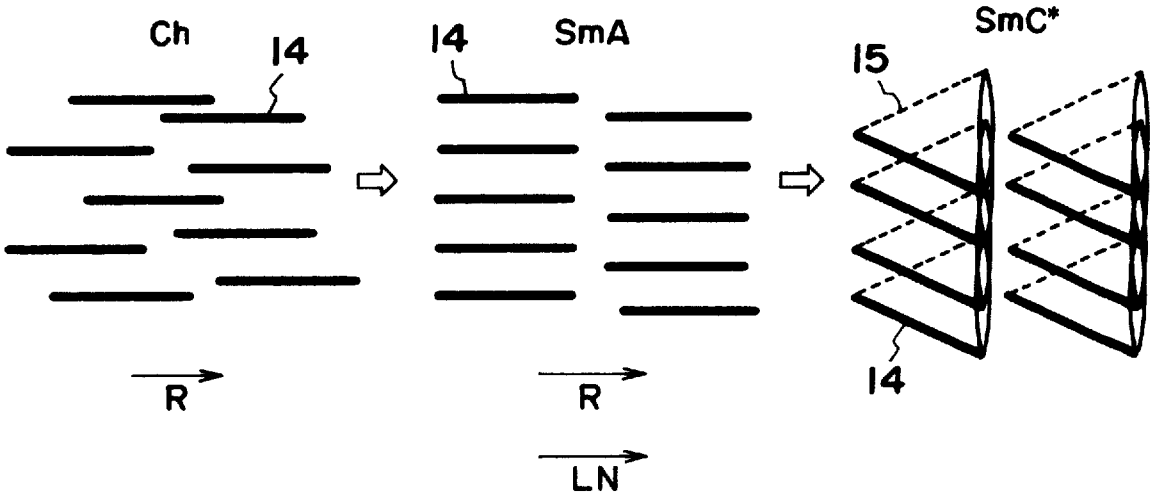
FIGS. 3A and 3B are illustrations of courses of smectic layer formation of liquid crystal molecules exhibiting a phase transition series of Ch (cholesteric phase)–SmA (smectic A phase)–SmC* (chiral smectic C phase) in an SSFLC-type device and a phase transition series of Ch–SmC* in an embodiment of a liquid crystal device used in the present invention, respectively.
Figure 3B:
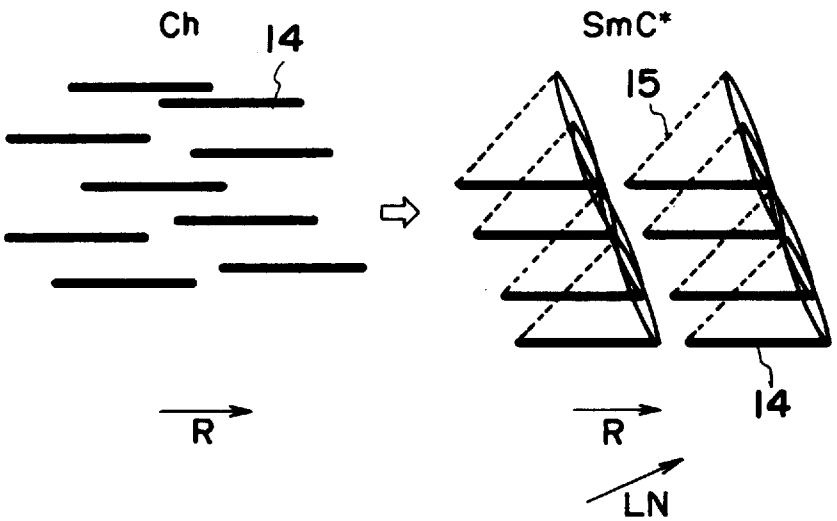

FIG. 3A shows a course (process) of formation of smectic layer structure of a liquid crystal material exhibiting a phase transition series on temperature decrease of at least Ch–SmA (smectic A phase)–SmC*, and FIG. 3B shows a course of smectic layer structure formation of a liquid crystal material exhibiting at least Ch–SmC* phase transition series on temperature decrease.

In these figures, an arrow R represents a direction of an average uniaxial aligning treatment axis, and an arrow LN represents a direction of a normal to smectic layer (layer normal direction). Further, the liquid crystal molecules 14 can effect switching along with the wall surface of the virtual cone 15 at the time of voltage application thereto.

Herein, a direction of the "average uniaxial aligning treatment axis" means a direction of a uniaxial aligning treatment axis direction in the case where only one of the pair of substrates is subjected to a uniaxial aligning treatment or a direction of two parallel uniaxial aligning treatment axes in the case where both of the pair of substrates are subjected to a uniaxial aligning treatment so that their uniaxial aligning treatment axes are parallel to each other and in the same direction or opposite directions (parallel relationship or anti-parallel relationship). Further, in the case where both of the substrates are subjected to a uniaxial aligning treatment so that their uniaxial aligning treatment axes intersect each other at a crossing angle, the "average uniaxial aligning treatment axis" direction means a direction of a bisector of the uniaxial aligning treatment axes (a half of the crossing angle).

Referring to FIG. 3A, in the case of the liquid crystal material having the phase transition series including SmA (smectic A phase), the liquid crystal molecules 14 are oriented in SmA so that the (smectic) layer normal direction LN is aligned with the uniaxial aligning treatment direction R, thus forming a smectic layer structure. In SmC*, the liquid crystal molecules 14 are tilted from the layer normal direction LN and stabilized at a position in the vicinity of or slightly inside an edge (side line) of the virtual cone 15.

On the other hand, in the case of the liquid crystal material having the SmA-less phase transition series suitably used in the present invention, as shown in FIG. 3B, the liquid crystal molecules 14 are oriented in the phase transition from Ch to SmC* so that they are tilted from the layer normal direction LN and also somewhat deviated or tilted from the average uniaxial aligning treatment axis direction, thus forming a smectic layer structure.

In the present invention, the liquid crystal material used is controlled so that the liquid crystal molecules 14 are stabilized at a position (slightly) inside the edge of the virtual cone 15 in an operation temperature range in SmC* to form a smectic layer structure having a chevron structure or an oblique bookshelf structure (where smectic layers are uniformly tilted from a direction of a normal to the substrates) providing a prescribed layer inclination angle.

In the case of a smectic layer structure having a complete bookshelf structure, the liquid crystal molecules 14 can also be stabilized inside the virtual cone edge in some cases including a case of a high pretilt angle or a case where liquid crystal molecules in a bulk state are twisted due to a strong polar interaction at a boundary with a substrate.

In the case where a liquid crystal material has a remarkable electroclinic effect, the liquid crystal molecules are tilted outside the virtual cone edge under application of an electric field. Such a liquid crystal material having the electroclinic effect is also applicable to the present invention, since in the liquid crystal device of the present invention, a deviation angle between the (liquid crystal) molecular orientation direction and the layer normal direction under electric field application is larger than a deviation angle therebetween under no electric field application. Specifically, when one of the polarizing axes of cross-nicol polarizers is aligned with the liquid crystal molecular direction under no electric field application to provide a darkest state, an optical axis of the liquid crystal material used is deviated from the polarizing axis in either case of a positive polarity voltage application and a negative polarity voltage application, thus realizing birefringence.

Next, as an example of the liquid crystal material usable in the present invention, a liquid crystal material having a chevron or oblique bookshelf structure providing a layer inclination angle will be described with reference to FIG. 4.

Figure 4A:
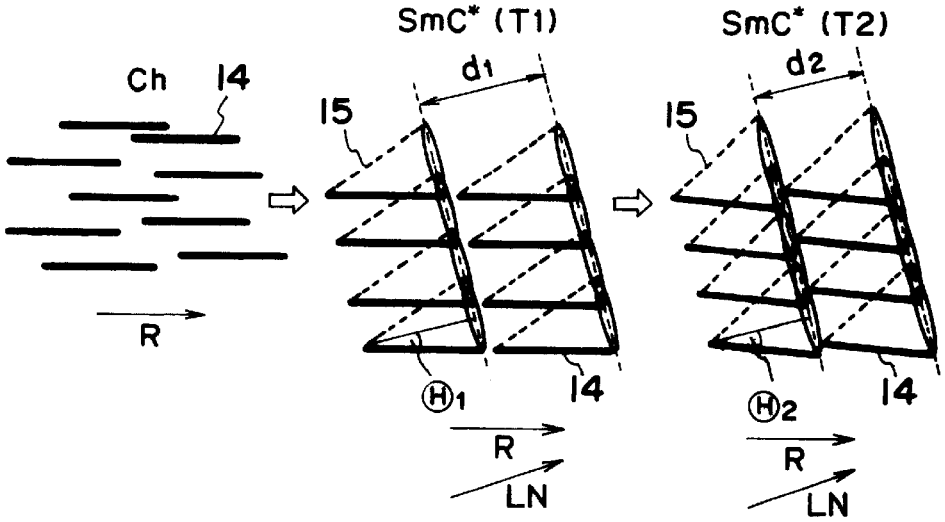

FIG. 4A shows a course of smectic layer structure formation of liquid crystal molecules assuming a phase transition series free from SmA similar to FIG. 3B.

Referring to FIG. 4A, the smectic layer structure is formed in the course of phase transition from Ch to SmC* (particularly, at a temperature immediately below a phase transition temperature from Ch to SmC*), wherein the liquid crystal molecules 14 are oriented or aligned so that they are tilted from the smectic layer normal direction LN.

In such a smectic layer structure formation, however, the cone angle Ⓗ (half of an apex angle of the virtual cone 15) is different, e.g., between a higher temperature state (T1) and a lower temperature state (T2) within SmC*–temperature range.

When a cone angle Ⓗ1 in the higher temperature state (T1) and a cone angle Ⓗ2 in the lower temperature state (T2) of a liquid crystal material used are set so as to satisfy a relationship Ⓗ1<Ⓗ2, in an ordinary case, a layer spacing d1 in T1 and a layer spacing d2 in T2 hold a relationship d1>d2.

Accordingly, if the liquid crystal material has a bookshelf structure in T1, the liquid crystal material in T2 provides a layer inclination angle δ at least satisfying an equation: $\delta=\cos^{-1}(d2/d1)$. As a result, in T2, the liquid crystal molecules of the liquid crystal material form a chevron or oblique bookshelf structure. Of these structures, the chevron structure will be described.

Figure 4B:
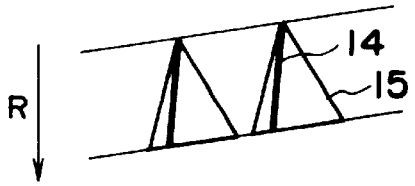
Figure 4C:
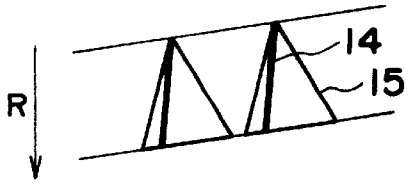
Figure 4B:
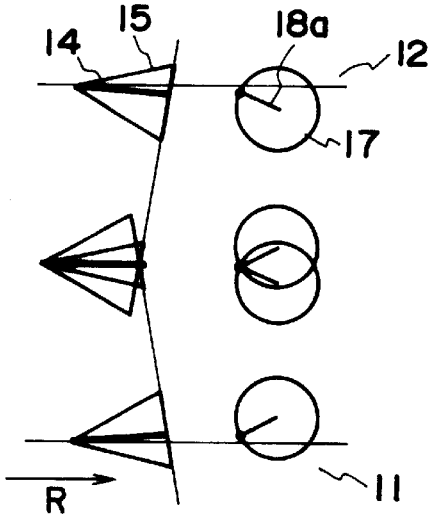
Figure 4C:
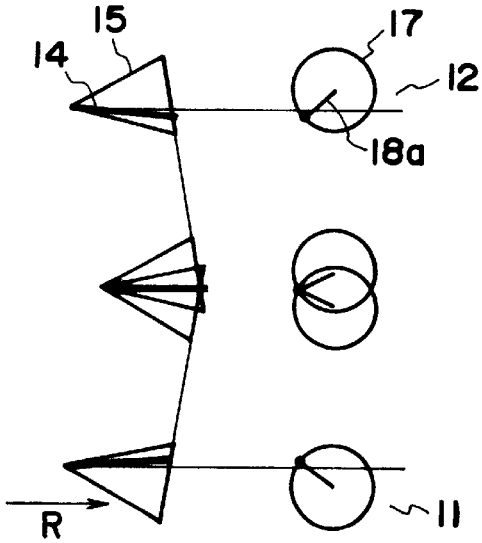

Layer structures and positions of C-directors of a liquid crystal material having a chevron structure are shown in FIGS. 4BA–4CB, wherein FIG. 4BA is a plan view showing a layer structure of liquid crystal molecules 14 in C1 alignment, and FIG. 4BB is a corresponding sectional view showing the layer structure and positions of C-directors of the liquid crystal molecules 14 in C1 alignment, and FIGS. 4CA and 4CB are those in C2 alignment, respectively.

In these figures, the identical reference numerals and symbols have the same meanings as in FIGS. 1 and 2.

As shown in these figures, the liquid crystal material having the chevron structure is controlled so that the liquid crystal molecules 14 are stabilized inside the edge of the virtual cone 15 based on the above-described relationships.

In all the cases shown in FIGS. 3A, 3B and 4A, the liquid crystal molecules 14, e.g., as shown in FIGS. 1A to 2B may be considered to be stabilized in a bistable alignment state in the chevron (layer) structure, i.e., in two stable states where the liquid crystal molecules are substantially parallel to the substrates 11 and 12. However, in the cases shown in FIGS. 3B and 4A, a constraint force becomes larger due to the uniaxial aligning treatment. As a result, only one of these two stable states is stabilized, whereby a memory characteristic (bistability) of the liquid crystal material is lost.

Figure 5:
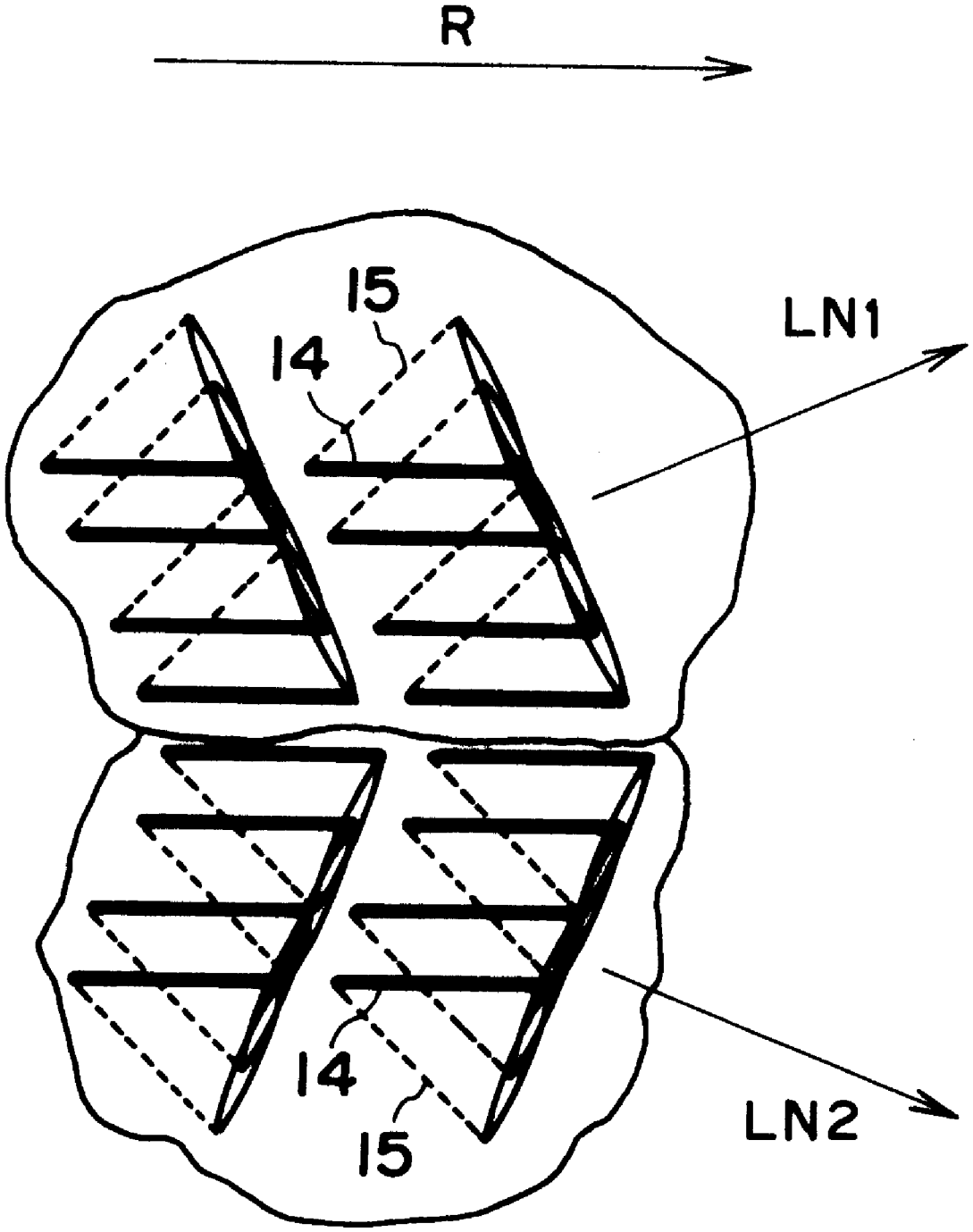
FIG. 5 is a schematic view showing an alignment state of liquid crystal molecules in chiral smectic C phase.

Further, it may be assumed that the liquid crystal molecules 14 form two smectic layer structures providing different layer normal directions LN1 and LN2 as shown in FIG. 5 at the time of the phase transition from Ch to SmC*, i.e., at a temperature immediately below the phase transition temperature from Ch to SmC*, as shown in FIGS. 3B and 4A. In this instance, if the pair of substrates between which the (chiral smectic) liquid crystal material is disposed are subjected to a completely symmetrical uniaxial aligning treatment, i.e., a uniaxial aligning treatment under identical conditions in terms of a treating direction, an alignment film material, etc., the two (different) smectic layer structures providing different layer normal directions (LN1 and LN2) shown in FIG. 5 are formed in an equivalent proportion. In the liquid crystal device of the present invention, two domains (first and second domains) D1 and D2 providing such two different smectic layer structures, respectively, are co-present.

In the liquid crystal device of the present invention, in each domain D1 or D2, the layer structure formation of the liquid crystal material used is performed so that a direction of deviation of the layer normal direction (LN1 or LN2) from the average uniaxial aligning treatment axis direction R is kept in a certain direction, whereby the liquid crystal molecules 14 are stabilized inside one of two edges of the virtual cone 15 under no voltage application as shown in FIGS. 4BA–4CA, thus attaining a memory characteristic-less SmC* alignment state.

Then, an inversion behavior (to an electric field) of liquid crystal molecules placed in such an alignment state that one of the two smectic layer structures shown in FIG. 5 is preferentially formed in a first domain D1 in a liquid crystal device of the present invention will be described with reference to FIGS. 6AA to 6D.

In these figures, the liquid crystal device employs a parallel rubbing cell (a pair of substrates subjected to a rubbing treatment (as a uniaxial aligning treatment) so that two rubbing directions are parallel and identical to each other), and the inversion behavior is explained with respect to the liquid crystal molecules in C2 alignment. However, inversion behaviors in the cases of, e.g., C1 alignment, oblique bookshelf structure and anti-parallel rubbing cell can be discussed similarly as in the case shown in FIGS. 6AA–6D as specifically described below.

FIGS. 6AA, 6BA and 6CA are plan views showing molecular behaviors (I) under application of a positive polarity electric field (E) (E>0), under no electric field application (E=0) and under application of a negative polarity electric field (E<0), respectively. FIGS. 6AB, 6BB and 6CB are sectional views showing molecular behaviors (II) corresponding to the molecular behaviors (I) shown in FIGS. 6AA, 6BA and 6CA, respectively, and also showing positions of corresponding C-directors (III) (projections onto a circular base of a virtual cone), respectively.

In FIGS. 6AA, 6BA and 6CA showing the molecular behaviors (I), the liquid crystal molecules 14 are illustrated as an average molecular axis thereof in a direction perpendicular to the substrates.

Under no electric field (voltage) application (E=0), as shown in FIG. 6BC, a C-director (projection) 18 on a circular base 17 (of a virtual cone 15) of a liquid crystal molecule 14 is somewhat deviated from an average uniaxial aligning treatment axis direction R, and spontaneous polarizations 19 of the liquid crystal molecules 14 are directed substantially in the same direction between a pair of substrates 11 and 12.

In this instance, when a cell (liquid crystal device) including a pair of polarizers arranged in cross-nicol relationship is disposed so that one of polarizing axes A and P (e.g., polarizing axis A) is aligned with the liquid crystal molecular position (molecular axis) under no voltage application (FIGS. 6BA, 6BB and 6D), a resultant transmitted light quantity passing through the liquid crystal layer is minimized to provide a darkest state (black display state).

When the liquid crystal molecules 14 placed in the alignment state shown in FIGS. 6BA and 6BB (E=0) are supplied with an electric field (voltage) E, the liquid crystal molecules 14 are tilted (switched) to positions depending on the polarity of the applied voltage E as shown in FIGS. 6AA, 6AB, 6CA and 6CB, while having spontaneous polarizations 19 (substantially) uniformly directed to a direction of the applied voltage E. An angle of tilting based on the molecular position 14 under no voltage application (E=0) (hereinbelow, referred to as "tilting angle") is increased depending on a magnitude (absolute value) of the applied voltage E. However, as apparent from FIGS. 6AA (E<0) and 6CA (E>0) when compared with FIG. 6BA (E=0), the tilting angle (based on the molecular position under E=0) in the case of application of the positive polarity (one polarity) voltage (E>0, FIG. 6CA) is largely different from that in the case of application of the negative polarity (the other polarity) voltage (E<0, FIG. 6AA) even if absolute values of these (positive polarity and negative polarity) voltages are identical to each other.

Herein, in the first domain D1 (also in the second domain D2), the liquid crystal provides a first (light)transmittance under no voltage application, a second transmittance under application of a first (e.g., positive) polarity voltage, and a third transmittance under application of a second (e.g., negative) polarity voltage.

In the case of no voltage application (E=0) as shown in FIG. 6BA, the liquid crystal molecules 14 are (mono-) stabilized in a position which is tilted from the (smectic) layer normal direction. In this instance, when sufficiently larger voltages of positive and negative polarities, each having an absolute value further larger than that of the voltage E, are applied to the liquid crystal molecules 14, respectively, the respective liquid crystal molecules 14 are further changed in their positions from those shown in FIGS. 6AA and 6CA, respectively, so that the directions of spontaneous polarization of the liquid crystal molecules even in the vicinities of boundaries with the substrates 11 and 12 are also aligned with the directions of electric fields E (E<0, E>0), respectively, similar to those of the liquid crystal molecules 14 in a bulk state. As a result, almost all the liquid crystal molecules 14 within the cell are present at the (virtual) cone edges, thus providing (two) maximum tilt states depending on the polarity of the applied voltage based on the molecular position under no voltage application (E=0, FIG. 6BA). As a result, the liquid crystal molecules 14 are placed in a uniform alignment state substantially free from twisting thereof at two extreme molecular positions (on the virtual cone 15) a bisector of which (corresponding to the layer normal direction) is a symmetric axis thereof.

In the present invention, as described above, one of the maximum tilt states of the liquid crystal molecules 14 is controlled to be different from the other maximum tilt state, whereby a maximum tilting angle $\beta 1$ (based on the mono-stabilized molecular position under E=0) in one maximum tilt state under the positive polarity voltage application (E>0, FIG. 6CA) becomes larger than a maximum tilting angle $\beta 2$ in the other maximum tilt state under the negative polarity voltage application (E<0, FIG. 6AA), thus satisfying $\beta 1 > \beta 2 > 0$ in the first domain D1.

In the case where $\Delta nd$ ($\Delta n$: refractive index anisotropy; d: cell thickness or thickness of liquid crystal layer) is set to be a value equal to ca. ½ of a wavelength of visible light, a positive polarity voltage application (E>0) as shown in FIG. 6CA provides a prescribed emitting light quantity from (or a quantity of transmitted light passing through) the liquid crystal device, i.e., a prescribed tilt state (providing a maximum second transmittance), with an increase in magnitude (absolute value) of the applied voltage E, thus providing a second emitting light quantity most different from a first emitting light quantity under no voltage application (E=0) (within a range of the positive polarity voltage application), i.e., a maximum transmitted light quantity (in the case of E>0).

On the other hand, as shown in FIG. 6A, a negative polarity voltage application (E<0) provides an increased transmitted light quantity passing through the liquid crystal device, but a degree of optical response corresponding to the transmitted light quantity is considerably lower than the case of E>0 and provides a third emitting light quantity most different from the first emitting light quantity (E=0) (within a range of the negative polarity voltage application), i.e., a maximum transmitted light quantity (in the case of E<0) when the liquid crystal molecules are placed in a prescribed tilt state (providing a maximum third transmittance) under application of a prescribed (negative polarity) voltage (having an absolute value identical to that of the positive voltage providing the second emitting light quantity).

However, a difference in maximum transmitted light quantity between the negative polarity voltage application (E<0, FIG. 6AA) and no voltage application (E=0, FIG. 6BA) is smaller than a difference in maximum transmitted light quantity between the positive polarity voltage application (E>0, FIG. 6CA) and no voltage application (E=0, FIG. 6BA), thus attaining a maximum transmitted light quantity of the liquid crystal device of the present invention under the positive polarity voltage application.

In the case where a pair of polarizers having polarizing axes A and P as shown in FIG. 6D is used, if a tilting angle (based on the monostabilized molecular position under E=0) of the liquid crystal molecules 14 in the maximum tilt state under E>0 is at most 45 degrees, the liquid crystal molecules 14 located on the virtual cone 15 edge (i.e., in the maximum tilt state providing the maximum second transmittance) provide the maximum transmitted light quantity under E>0 (i.e., the second emitting light quantity). If the tilting angle of the liquid crystal molecules 14 is above 45 degrees, the liquid crystal molecules 14 located inside the virtual cone edge provide the maximum transmitted light quantity under E>0 (the second emitting light quantity). On the other hand, in the case of applying the negative polarity voltage (E<0), the liquid crystal molecules 14 can provide the maximum transmitted light quantity under E<0 (i.e., the third emitting light quantity) in the maximum tilt state (providing the maximum third transmittance) irrespective of the tilting angle thereof (based on the molecular position under E=0).

Figure 7:
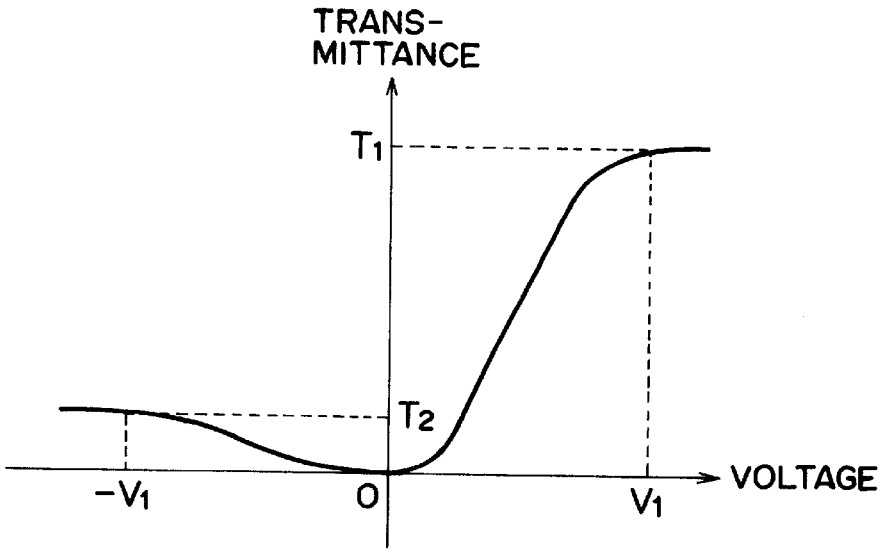
FIG. 7 is a graph showing an example of a V-T (voltage-transmittance) characteristic of a liquid crystal device of the present invention.

The liquid crystal device using the liquid crystal material exhibiting the above-described switching (inversion) behavior of liquid crystal molecules may, e.g., exhibit a voltage-transmittance (V-T) characteristic, particularly in the case where liquid crystal molecules are placed in a maximum (largest) tilt state under positive polarity voltage application, as shown in FIG. 7.

Referring to FIG. 7, when a voltage (V) of a positive polarity is applied, a resultant transmittance (T) is continuously increased with a magnitude (absolute value) of the applied (positive polarity) voltage (V) due to tilting of the liquid crystal molecules and shows a maximum transmittance T1 under application of a voltage V1 or above. On the other hand, when a negative polarity voltage is applied, the transmittance (T) is somewhat continuously increased with an increasing magnitude of the applied (negative polarity) voltage (V) but is saturated at T2, which is considerably lower than T1, under application of a voltage −V1 or above (as an absolute value).

Particularly, in a preferred embodiment, the maximum tiltinig angles $\beta 1$ and $\beta 2$ satisfy the following relationships:

$$\beta 1 \geqq 5 \times \beta 2 \text{ in first domain } D1,$$

and $$\beta 1 \leqq (1/5) \times \beta 2 \text{ in second domain } D2.$$

Further, in the first domain D1, a ratio of a maximum transmitted light quantity under application of the positive (first) polarity voltage in the maximum tilt state of the liquid crystal molecules (the average molecular axis) (e.g., a transmitted light quantity (i.e., a difference between the second transmittance (E>0) and the first transmittance (E=0) at T1 shown in FIG. 7) to that under application of the negative (second) polarity voltage in the other maximum tilt state (e.g., a transmitted light quantity (i.e., a difference between the third transmittance (E<0) and the first transmittance (E=0) at T2 shown in FIG. 7) may preferably be at least 5.

On the other hand, in the first domain D2, a ratio of a maximum transmitted light quantity under application of the negative (second) polarity voltage in the maximum tilt state of the liquid crystal molecules (the average molecular axis) (e.g., a transmitted light quantity (i.e., a difference between the third transmittance (E<0) and the first transmittance (E=0)) to that under application of the positive (first) polarity voltage in the other maximum tilt state (e.g., a transmitted light quantity (i.e., a difference between the second transmittance (E<0) and the first transmittance (E=0)) may preferably be at least 5.

By satisfying the above-mentioned relationships (and ratios) in the first and second domains D1 and D2, it becomes possible to most effectively perform image display substantially in accordance with a 1H inversion driving scheme while suppressing flickering.

Hereinbelow, an inversion (switching) mechanism of liquid crystal molecules placed in some alignment states of a liquid crystal material used in the liquid crystal device according to the present invention will be described by contrast with the SSFLC device.

When liquid crystal molecules of the SSFLC are placed in the C1 and C2 alignment states shown in FIGS. 1A, 1B, 2A and 2B, the liquid crystal molecules are required to pass or overcome an energy barrier of a certain potential level in order to effect switching between bistable states thereof in each of the C1 and C2 alignment states. The presence of the energy barrier is the origin of bistability of a chiral smectic liquid crystal.

On the other hand, in the liquid crystal device of the present invention, when liquid crystal molecules are, e.g., placed in an alignment state as shown in FIG. 5, the liquid crystal molecules 14 are extremely stabilized at a position closer to a position at one of the bistable potentials of the SSFLC, thus resulting in only one stable state. As a result in the present invention, an analog-like stable state is present depending on a magnitude of an applied voltage, and the applied voltage provides one-to-one (corresponding) relationship, thus realizing inversion switching in a continuous manner without forming a domain (domain wall).

Examples of the energy barrier (potential level) are shown in FIGS. 8A, 8B, 9A and 9B.

Figure 8A:
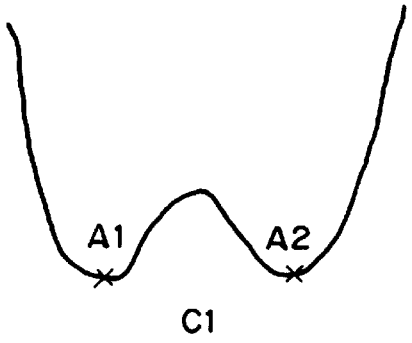
FIGS. 8A and 8B are illustrations of states of energy potentials of an SSFLC in C1 alignment and C2 alignment, respectively.
Figure 8B:
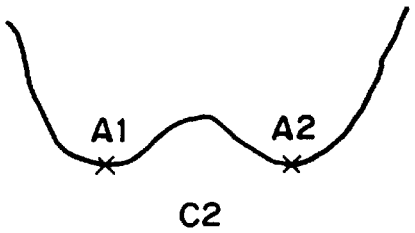

FIGS. 8A and 8B show potential curves of the SSFLC in C1 alignment and C2 alignment, respectively.

Referring to FIGS. 8A and 8B, A1 represents a potential in one stable state, and A2 represents a potential in the other stable state.

As apparent from these figures, the SSFLC exhibits a potential state somewhat different in (potential) level between C1 alignment and C2 alignment.

In the case of C1 alignment of the SSFLC, an angle formed between average molecular axes in bistable states in the vicinity of the SSFLC with the substrate is larger than that in the case of C2 alignment (of the SSFLC) (FIGS. 2A and 2B), thus resulting in a higher energy barrier.

Figure 9A:
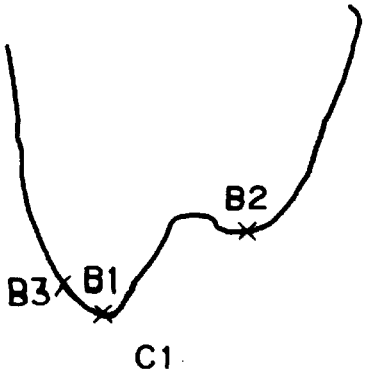
FIGS. 9A and 9B are illustrations of states of energy potentials of a liquid crystal material in a liquid crystal device of the present invention in C1 alignment and C2 alignment, respectively.
Figure 9B:
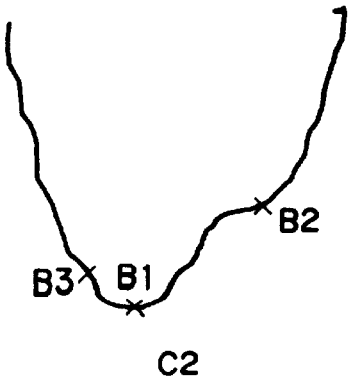

On the other hand, FIGS. 9A and 9B show potential curves of a liquid crystal material in C1 alignment and C2 alignment, respectively, used in the liquid crystal device of the present invention.

Referring to FIGS. 9A and 9B, B1 represents a potential under no voltage application (in the case of E=0 shown in FIGS. 6BA an 6BB), B2 represents a potential (of liquid crystal molecules in a maximum tilt state) under positive polarity voltage application (in the case of E>0 shown in FIGS. 6CA and 6CB), and B3 represents a potential (of liquid crystal molecules in a maximum tilt state) under negative polarity voltage application (in the case of E<0 shown in FIGS. 6AA and 6AB).

As shown in these figures, the potential curves in C1 alignment and C2 alignment are quite different from those of the SSFLC, respectively, thus resulting in a different driving characteristic.

Particularly, in C1 alignment providing higher energy barrier, as shown in FIG. 9A, even when the liquid crystal molecules are extremely stabilized at a position at the potential B1, a position at the potential B2 can provide the liquid crystal molecules with a stable state or metastable state (wherein the potential B2 is relatively higher but is stable when compared with other positions). As a result, when the voltage application for optical response of the liquid crystal molecules in C1 alignment is performed, as analog-like stable state depending on a magnitude of the applied voltage is present, and the applied voltage and the resultant stable molecular position provide a one-to-one relationship, thus realizing a continuous inversion switching with no domain wall formation. However, in some cases, a discontinuous (discrete) alignment state is formed, i.e., a discontinuous inversion behavior with domain wall formation is effected, when the potential exceeds a certain level.

On the other hand, in C2 alignment as shown in FIG. 9B, the energy barrier in the case of the SSFLC is lower. Accordingly, even when a position at the potential B1 is extremely stabilized, it is possible to realize a continuous inversion switching with no domain wall formation to a position at the potential B2.

As is also understood from FIGS. 9A and 9B, a driving voltage is liable to become higher in the case of C1 alignment.

As described above, with respect to an alignment state of liquid crystal molecules in the present invention, C2 alignment may preferably be adopted in a parallel rubbing cell in view of an analog-like gradational display performance and a lower driving voltage. Further, in the case where the alignment state of liquid crystal molecules is one wherein C1 alignment and C2 alignment are co-present, a lower pretilt angle and/or an anti-parallel rubbing relationship may desirably be adopted in order to minimize fluctuations in analog-like gradational display performance and driving voltage.

In the present invention, the above-described liquid crystal device exhibiting the inversion switching behavior such that the liquid crystal molecules 14 are (mono-)stabilized inside one of the edges of the virtual cone 15 under no voltage application to lose a memory characteristic (bistability) in SmC* and are switched depending on the applied voltage value as shown in FIGS. 6AA, 6AB, 6BA, 6BB, 6CA, 6CC, 9A and 9B and the V-T (optical response) characteristic as shown in FIG. 7 may, e.g., be prepared by using an appropriate liquid crystal material, controlling appropriately a cell design and effecting such a treatment that an internal potential within a cell in the course of the phase transition from Ch to SmC* is localized.

In the present invention, as the liquid crystal material, a chiral smectic liquid crystal material (or composition) may preferably be used.

Examples of the chiral smectic liquid crystal material may include those of hydrocarbon-type containing a phenylpyrimidine skeleton, a biphenyl skeleton and/or a phenylcyclohexane ester skeleton. In the case where these materials have a layer spacing (d)-changing characteristic in a chiral smectic phase temperature range such that a layer spacing ($d_{tc}$) at the upper limit temperature of the chiral smectic phase is a maximum value ($d<d_{tc}$) and a chevron (layer) structure within a cell, these materials may appropriately be blended to prepare a chiral smectic liquid crystal composition providing a layer inclination angle δ (degrees) satisfying: 3 (deg.)<δ<Ⓗ (δ: an inclination angle of smectic layer from a normal to substrate within the cell; Ⓗ: the above-mentioned cone angle which is half of the apex angle of the virtual cone).

It is also possible to use at least one species of liquid crystal materials of hydrocarbon-type containing a naphthalene skeleton or fluorine-containing liquid crystal materials. These materials may generally exhibit a substantially certain layer spacing (d) within a chiral smectic phase temperature range and δ≦3 (deg.) within a cell. In this instance, these materials may preferably be blended so as to prepare a chiral smectic liquid crystal composition exhibiting a cone angle Ⓗ-changing characteristic such that a cone angle Ⓗ at a temperature immediately below the phase transition temperature from a higher temperature phase to chiral smectic phase is increased on temperature decrease within the chiral smectic phase temperature range.

In the present invention, a cone angle Ⓗ of the liquid crystal material in chiral smectic phase may ideally be at least 22.5 deg. in order to further enhance a contrast between two states providing maximum and minimum light quantities based on switching of liquid crystal materials (e.g., in order to further increase the maximum transmittance T1 (E>0) in the V-T characteristic shown in FIG. 7). On the other hand, when the cone angle Ⓗ is very large, a tilting angle from the monostabilized state under the other polarity voltage application (i.e., a tilting angle toward the alignment state shown in FIG. 6AA (E<0)) also becomes larger. As a result, e.g., the maximum transmittance T2 (E<0) in the V-T characteristic shown in FIG. 7 becomes larger, thus being liable to provide a substantial time aperture rate of 100%. In view of this phenomenon, the cone angle may preferably be below 30 deg. Further, if the cone angle Ⓗ is largely changed with temperature, a darkest state within a cell provided with a pair of cross-nicol polarizers is liable not to be maintained. For this reason, the cone angle Ⓗ may preferably be controlled so that its value within a driving temperature range for the liquid crystal device is fluctuated within ±3 deg.

In the case where the liquid crystal material has a layer spacing-changing characteristic such that a layer spacing is decreased by tilting of liquid crystal molecules from a (smectic) layer normal direction similar to an ordinary liquid crystal material assuming SmC* (i.e., in the case of a liquid crystal material providing an increasing cone angle Ⓗ on temperature decrease), a factor of decreasing the layer spacing becomes larger. However, when the liquid crystal material used is, e.g., a fluorine-containing liquid crystal material which per se spontaneously exhibits a bookshelf (layer) structure, the change in layer spacing can be made very small based on a property intrinsic to the fluorine-containing liquid crystal material such that the layer spacing measured in a bulk state becomes larger on temperature decrease. This may be considered to be the reason why the fluorine-containing liquid crystal material is not readily formed in a chevron structure. In this instance, liquid crystal molecules at a boundary with a substrate are aligned with a rubbing (uniaxial aligning treatment) direction due to a uniaxial aligning control force and bulk liquid crystal molecules are oriented in a direction deviated from the rubbing direction depending on the temperature characteristic of the cone angle Ⓗ in some cases. At that time, if an electric field is applied to the liquid crystal material, the boundary liquid crystal molecules are also oriented in a direction deviated from the rubbing direction similar to the bulk liquid crystal molecules.

Incidentally, in order to provide an internal potential localization within the liquid crystal device for preferentially forming one of two (smectic) layer structures in each of the first and second domains D1 and D2, respectively, as shown in FIG. 5, i.e., for making constant a deviation direction of a smectic layer normal from an average uniaxial aligning treatment axis in each of the domains D1 and D2 while providing mutually opposite deviation directions, for example, the following methods (1)–(4) may be adopted.

(1) During a phase transition from Ch to SmC* or from Iso. to SmC*, a DC (direct current) voltage of a positive or negative polarity is applied between a pair of substrates.

(2) A pair of substrates is provided with alignment films different in material, respectively.

(3) A pair of substrates, each provided with an alignment film, is subjected to different treating methods in terms of, e.g., film-forming conditions, rubbing strength, and UV irradiation conditions.

(4) A pair of substrates, each provided with an alignment film, is further provided with a layer underlying the alignment film, and the underlying layer is changed in material or thickness for each substrate.

In the above method (1), in order to avoid a change of the alignment film per se such that the alignment film is caused to have a permanent dipole (electret formation) due to a DC voltage application for a long period of time, the DC voltage application time may preferably be as short as possible if it is sufficient to provide a uniform layer formation direction. Specifically, the applied DC voltage may preferably be 100 mV to 10 V.

Ions (impurities) within the above-mentioned liquid crystal materials and the alignment films as used in the above methods (2), (3) and (4) may desirably be present as minimally as possible so as not to adversely affect TFT-driving scheme.

In order to monostabilize liquid crystal molecules (average molecular axis) under no voltage application within the liquid crystal device of the present invention, a uniaxial aligning control force is required to be large.

With respect to this aligning control force, an evaluation method using a cholesteric liquid crystal has been proposed by Uchida et al., Liquid Crystals, vol. 5, p. 1127 (1989). More specifically, according to this method, it is possible to evaluate the aligning control force by determining an "effective twisting angle" based on a torque balance between a helical pitch in the cholesteric phase and the aligning control force.

In the present invention, based on this method, the uniaxial aligning control force may be evaluated as follows.

In the case where the liquid crystal material used in the liquid crystal device has a cholesteric phase, when there is no aligning control force, the following relationship is fulfilled:

$$dg/p=\phi/2\pi,$$

wherein dg represents a cell thickness, p represents a cholesteric (helical) pitch and ø represents a twisting angle within a cell.

On the other hand, in the case where a pair of substrates is subjected to uniaxial aligning treatment so that their uniaxial aligning treatment axes are parallel to each other to provide an infinite (extremely larger) aligning control force, the resultant twisting angle ø becomes zero. The twisting angle ø may be readily determined by measuring optical rotation through a polarizing microscope similar to the above Uchida et al. method. More specifically, within the cell, the cholesteric liquid crystal has a virtual helical pitch $p^*(=2\pi\times dg/ø)$ larger than the original helical pitch p due to the aligning control force. In other words, the aligning control force may be defined as zero when $p^*=p$ and infinite when $p^*$ is infinite.

In the present invention, it is preferred to at least satisfy $p^*\geqq 2xp$, more preferably $p^*\geqq 10xp$ in order to ensure the monostabilization.

In view of the above conditions, in the present invention, it is preferred to appropriately set uniaxial aligning treatment (e.g., rubbing) conditions, aligning film thickness, alignment film material, curing conditions for the aligning film, etc. according to the above-mentioned methods (2)–(4).

In the present invention, when a V-T characteristic is determined under application of a triangular wave, a hysteresis phenomenon is observed in some cases.

However, when the liquid crystal device is driven according to the frame inversion driving scheme, the hysteresis phenomenon is of substantially no problem since a continuous optical modulation from a white state to a halftone state as in the case of the triangular wave application is not effected. More specifically, in the case of the frame inversion driving, an optical modulation is performed while always effecting inversion between white and black (alignment) states depending on a polarity of an applied voltage. For example, when an optical modulation from a white state to a halftone state, the white to halftone optical modulation is performed from the white state to the halftone state via a black state, so that an adverse effect of a previous display state (display history) can be considerably suppressed.

Hereinbelow, an embodiment of the liquid crystal device of the present invention will be described with reference to FIG. 10.

Figure 10:
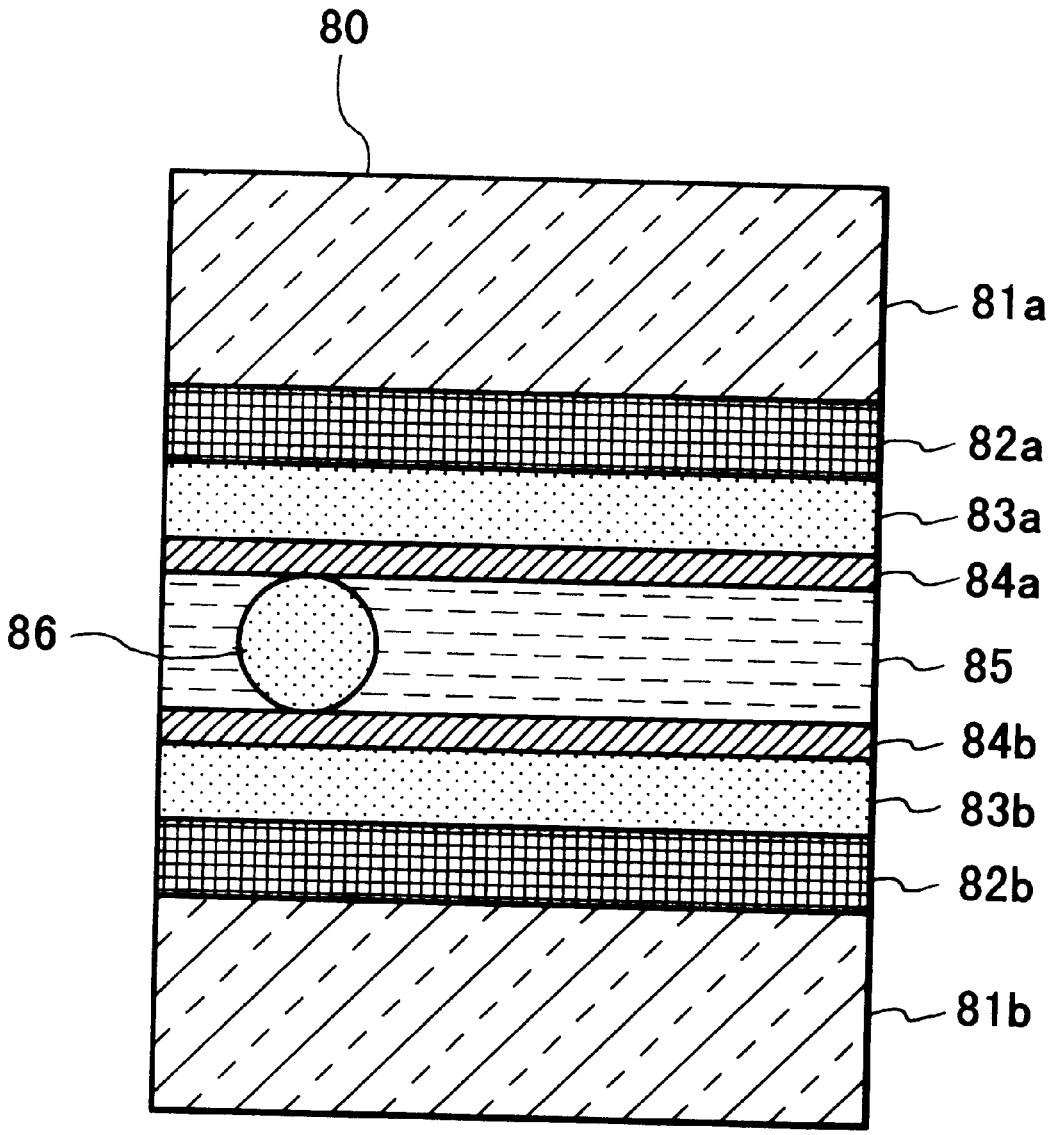
FIG. 10 is a schematic sectional view of an embodiment of a liquid crystal device of the present invention.

FIG. 10 shows a schematic sectional view of a liquid crystal device 80 according to the present invention.

The liquid crystal device 80 includes a pair of substrates 81*a* and 81*b;* electrodes 82*a* and 82*b* disposed on the substrates 81*a* and 81*b,* respectively; insulating films 83*a* and 83*b* disposed on the electrodes 82*a* and 82*b,* respectively; alignment control films 84*a* and 84*b* disposed on the insulating films 83*a* and 83*b,* respectively; a liquid crystal 85 disposed between the alignment control films 84*a* and 84*b;* and a spacer 86 disposed together with the liquid crystal 85 between the alignment control films 84*a* and 84*b.*

The liquid crystal 85 may preferably assume chiral smectic phase.

Each of the substrates 81*a* and 81*b* comprises a transparent material, such as glass or plastics, and is coated with, e.g., an electrode 82*a* (82*b*) of $In_2O_3$ or ITO (indium tin oxide) for applying a voltage to the liquid crystal 85. One of the substrates 81*a* and 81*b* may be provided with a matrix electrode structure, wherein dot-shaped transparent electrodes are disposed in a matrix form, and each of the transparent electrodes is connected to a switching element, such as a TFT (thin film transistor) or MIM (metal-insulator-metal), and the other substrate may be provided with a counter (common) electrode on its entire surface or in a prescribed pattern, thus constituting an active matrix-type liquid crystal device.

On the electrodes 82*a* and 82*b,* the insulating films 83*a* and 83*b,* e.g., of $SiO_2$, $TiO_2$ or $Ta_2O_5$ having a function of preventing an occurrence of short circuit may be disposed, respectively, as desired.

On the insulating films 83*a* and 83*b,* the alignment control films 84*a* and 84*b* are disposed so as to control the alignment state of the liquid crystal 85 contacting the alignment control films 84*a* and 84*b.* At least one of (preferably both of) the alignment control films 84*a* and 84*b* is subjected to a uniaxial aligning treatment (e.g., rubbing). Such an alignment control film 84*a* (84*b*) may be prepared by forming a film of an organic material (such as polyimide, polyimideamide, polyamide or polyvinyl alcohol through wet coating with a solvent, followed by drying and rubbing in a prescribed direction or by forming a deposited film of an inorganic material through an oblique vapor deposition such that an oxide (e.g., SiO) or a nitride is vapor-deposited onto a substrate in an oblique direction with a prescribed angle to the substrate.

The alignment control films 84*a* and 84*b* may appropriately be controlled to provide liquid crystal molecules of the liquid crystal 85 with a prescribed pretilt angle a (an angle formed between the liquid crystal molecule and the alignment control film surface at the boundaries with the alignment control films) by changing the material and treating conditions (of the uniaxial aligning treatment).

In the case where both of the alignment control films 84*a* and 84*b* are subjected to the uniaxial aligning treatment (rubbing), the respective uniaxial aligning treatment (rubbing) directions may appropriately be set in a parallel relationship, an anti-parallel relationship or a crossed relationship providing a crossing angle of at most 45 degrees, depending on the liquid crystal material used.

The substrates 81*a* and 81*b* are disposed opposite to each other via the spacer 86 comprising, e.g., silica beads for determining a distance (i.e., cell gap) therebetween, preferably in the range of 0.3–10 $\mu$m, in order to provide a uniform uniaxial aligning performance and such an alignment state that an average molecular axis of the liquid crystal molecules under no electric field application is substantially aligned with an average uniaxial aligning treatment axis (a bisector of two uniaxial aligning treatment axes) although the cell gap varies its optimum range and its upper limit depending on the liquid crystal material used.

In addition to the spacer 86, it is also possible to disperse adhesive particles of a resin (e.g., epoxy resin) (not shown) between the substrates 81*a* and 81*b* in order to improve adhesiveness therebetween and an impact (shock) resistance of the liquid crystal having chiral smectic C phase (SmC*).

A liquid crystal device 80 having the above cell structure and a specific alignment state as shown in FIGS. 6AA to 6CB can be prepared by using a liquid crystal material 85 exhibiting a chiral smectic phase, while adjusting the composition thereof, and further by appropriate adjustment of the liquid crystal material treatment, the device structure including a material, and a treatment condition for alignment control films 84*a* and 84*b.* More specifically, the alignment state of FIGS. 6AA to 6CB is realized by a liquid crystal device wherein the liquid crystal molecules are aligned to provide an average molecular axis to be monostabilized under no voltage application and, under application of voltages of one polarity (a first polarity), are realigned to provide a tilting angle which varies continuously from the average molecular axis of the monostabilized position depending on the magnitude of the applied voltage. On the other hand, under application of voltages of the other polarity (i.e., a second polarity opposite to the first polarity), the liquid crystal molecules are tilted from the average molecular axis under no electric field depending on the magnitude of the applied voltages, but the maximum tilting angle obtained under application of the second polarity voltages is substantially smaller than the maximum tilting angle formed under application of the first polarity voltages. The liquid crystal material showing a chiral smectic phase may preferably exhibit a phase transition series on temperature decrease of Iso. (isotropic phase)–Ch (cholesteric phase)–SmC* (chiral smectic C phase) or Iso. phase–SmC* and be placed in a non-memory state in the SmC* by using the above-mentioned methods (1)–(4).

The liquid crystal material 85 showing chiral smectic phase may preferably be a composition prepared by appropriately blending a plurality of liquid crystal materials exhibiting, e.g., the above-described characteristics (in terms of a cone angle Ⓗ, a (smectic) layer spacing d and a layer inclination angle δ) selected from hydrocarbon-type liquid crystal materials containing a biphenyl, phenylcyclohexane ester or phenyl-pyrimidine skeleton, naphthalene-type liquid crystal materials and fluorine-containing liquid crystal materials.

When the liquid crystal device 80 as described above has such a cell structure that at least one of the substrates 81*a* and 81*b* is provided with a polarizer and the cell is disposed to provide a darkest state under no voltage application, a tilting angle of liquid crystal molecules (of the liquid crystal material 85) varies continuously under voltage application as described above to provide a V-T characteristic as shown in FIG. 7. As a result, a resultant transmitted light quantity of the device (emitting light quantity from the device) can be controlled in an analog-like manner with a change in applied voltage.

The liquid crystal device used in the present invention may be formed in a color liquid crystal device by providing one of the substrates 81*a* and 81*b* with a color filter comprising color filter segments of at least red (R), green (G) and blue (B).

In the present invention, the liquid crystal device may be applicable to various liquid crystal devices including: a liquid crystal device of a transmission-type wherein a pair of transparent substrates 81*a* and 81*b* is sandwiched between a pair of polarizers to optically modulate incident light (e.g., from an eternal light source) through one of the substrates 81*a* and 81*b* to be passed through the other substrate, and a liquid crystal device of a reflection-type wherein at least one of a pair of substrates 81*a* and 81*b* is provided with a polarizer to optically modulate incident light and reflected light and pass the light through the substrate on the light incident side. The reflection-type liquid crystal device may, e.g., be prepared by providing a reflection plate to either one of the substrates 81*a* and 81*b* or forming of a reflective material on one of the substrates or a reflecting member provided thereto.

In the present invention, by using the above-mentioned liquid crystal device in combination with a drive circuit for supplying gradation signals to the liquid crystal device, it is possible to provide a liquid crystal display apparatus capable of effecting a gradational display based on the above-mentioned alignment and V-T characteristics such that under voltage application, a resultant tilting angle varies continuously from the monostabilized position of the average molecular axis (of liquid crystal molecules) and a corresponding transmitted or emitting light quantity continuously changes.

For example, it is possible to use, as one of the pair of substrates, an active matrix substrate provided with a plurality of switching elements (e.g., TFT (thin film transistor) or MIM (metal-insulator-metal)) in combination with a drive circuit (drive means), thus effecting an active matrix drive based on amplitude modulation to allow a gradational display in an analog-like gradation manner.

Hereinbelow, an embodiment of a liquid crystal display apparatus of the present invention including a liquid crystal device provided with such an active matrix substrate will be explained with reference to FIGS. 11–13.

Figure 11:
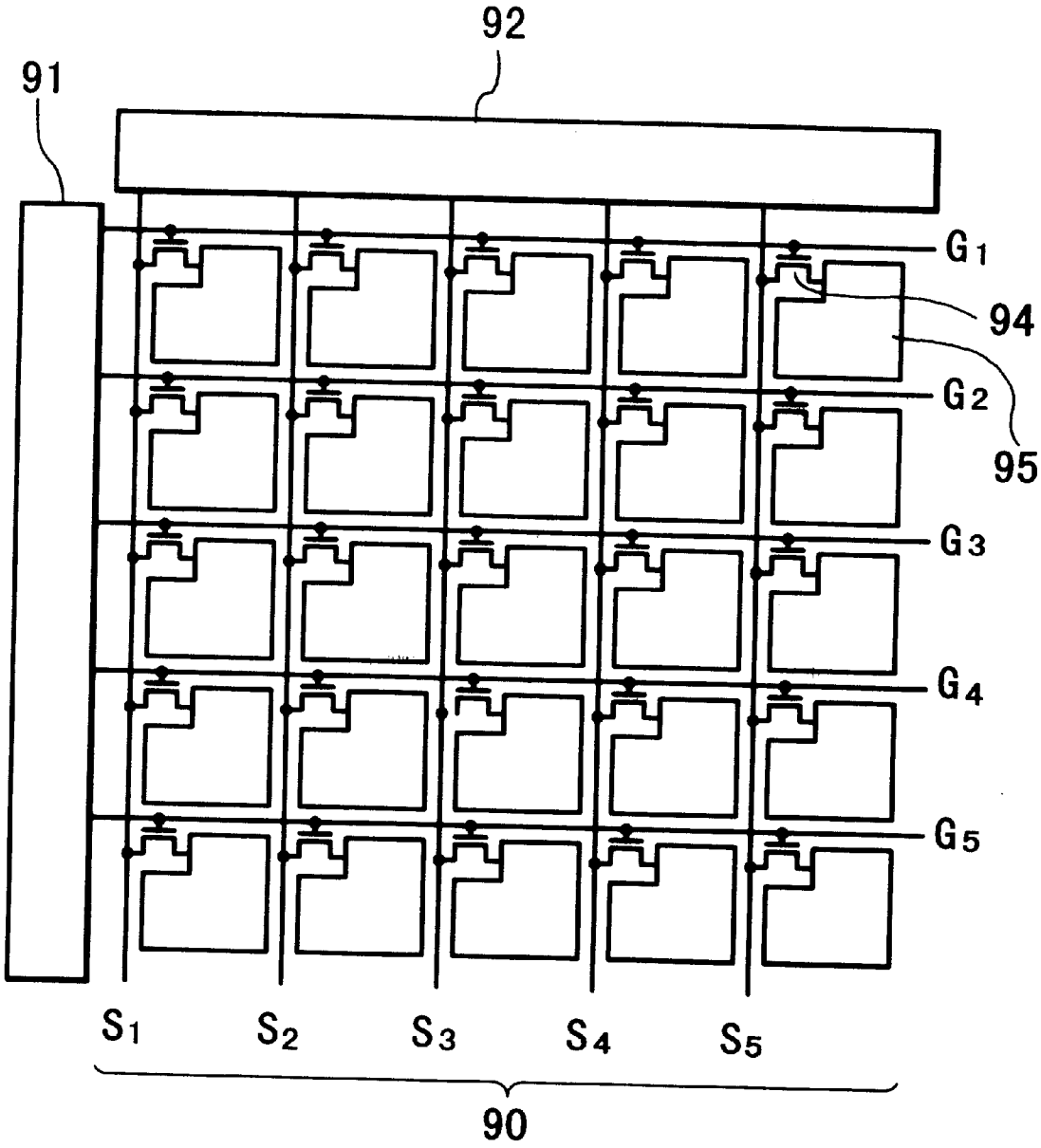
FIG. 11 is a schematic plan view of an embodiment of an active matrix-type liquid crystal device according to the present invention in combination with drive circuits therefor.

FIG. 11 shows a schematic plan view of such a display apparatus including a liquid crystal device and a drive circuit (means) and principally illustrates a structure on the active matrix substrate side.

Referring to FIG. 11, a liquid crystal device (panel) 90 includes a structure such that gate lines (G1, G2, G3, G4, G5, . . . ) corresponding to scanning lines connected to a scanning signal driver 91 (drive means) and source lines (S1, S2, S3, S4, S5, . . . ) corresponding to data signal lines connected to a data signal driver 92 (drive means) are disposed to intersect each other at right angles in an electrically isolated state, thus forming a plurality of pixels (5×5 in FIG. 11) at each intersection thereof. Each pixel is provided with a thin film transistor (TFT) 94 as a switching element and a pixel electrode 95 (as an effective drive region). The switching element may be a metal-insulator-metal (MIM) element. The gate lines (G1, G2, . . . ) are connected with gate electrodes (not shown) of the TFT 94, respectively, and the source lines (S1, S2, . . . ) are connected with source electrodes (not shown) of the TFT 94, respectively. The pixel electrodes 95 are connected with drain electrodes (not shown) of the TFT 94, respectively.

A gate voltage is supplied to the gate lines (G1, G2, . . . ) from the scanning signal driver 91 by effecting scanning selection in, e.g., a line-sequential manner. In synchronism with this scanning selection on the gate lines, the source lines (S1, S2, . . . ) are supplied with a data signal voltage depending on writing data for each pixel from the data signal driver 92. The thus-supplied gate and data signal voltages are applied to each pixel electrode 95 via the TFT 94.

Figure 12:
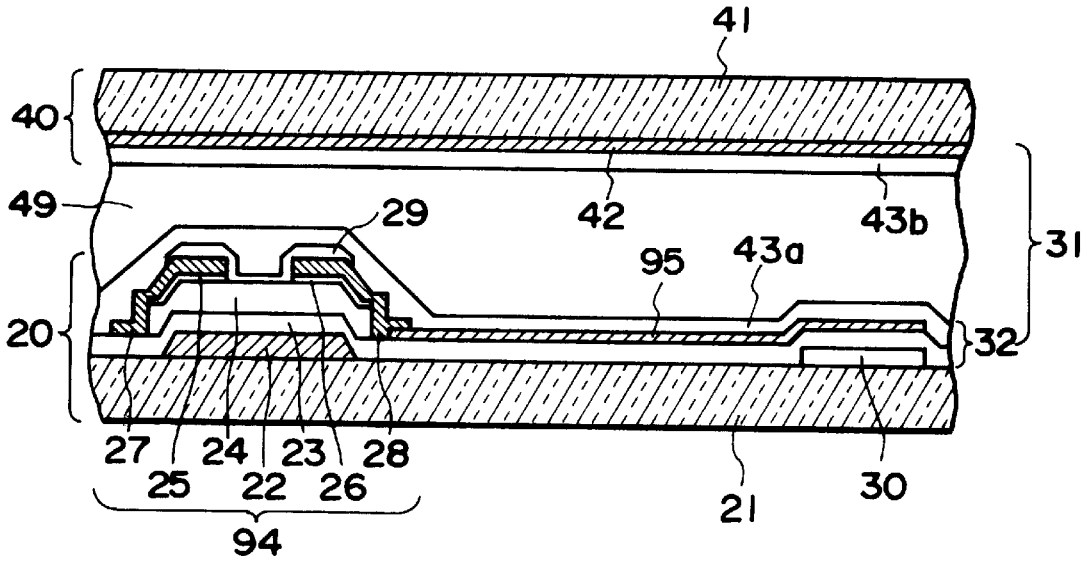
FIG. 12 is an enlarged sectional view showing each pixel portion of the liquid crystal device shown in FIG. 11.

FIG. 12 shows a sectional structure of each pixel portion (corresponding to 1 bit) in the panel structure shown in FIG. 11.

Referring to FIG. 12, a layer of a liquid crystal material 49 having a spontaneous polarization is sandwiched between an active matrix substrate or plate 20 provided with a TFT 94 and a pixel electrode 95 and an opposing substrate or plate 40 provided with a common electrode 42, thus providing a liquid crystal capacitor (Clc) 31 of the liquid crystal layer 49.

In this embodiment, the active matrix substrate 20 includes an amorphous silicon (a-Si) TFT as the TFT 94. The TFT may be of a poly crystalline-Si type, i.e., (p-Si) TFT.

The TFT 94 is formed on a substrate 21 of, e.g., glass and includes: a gate electrode 22 connected with the gate lines (G1, G2, . . . shown in FIG. 11); an insulating film (gate insulating film) 23 of, e.g., silicon nitride (SiNx) formed on the gate electrode 22; an a-Si layer 24 formed on the insulating film 23; $n^+$ a-Si ohmic contact layers 25 and 26 formed on the a-Si layer 24 and spaced apart from each other; a source electrode 27 formed on the $n^+$ a-Si layer 25; a drain electrode 28 formed on the $n^+$ a-Si layer 26 and spaced apart from the source electrode 27; a channel protective film 29 partially covering the a-Si layer 24 and the source and drain electrodes 27 and 28. The source electrode 27 is connected with the source lines (S1, S2, . . . shown in FIG. 11), and the drain electrode 28 is connected with the pixel electrode 95 (FIG. 11) of a transparent conductor film (e.g., ITO film). The TFT 94 is placed in an "ON" state by applying a gate pulse to the gate electrode 22 during a scanning selection period of the corresponding gate line.

Further, on the active matrix substrate 20, a structure constituting a holding or storage capacitor (Cs) 32 is formed by the pixel electrode 95, a storage capacitor electrode 30 disposed on the substrate 21, and a portion of the insulating film 23 sandwiched therebetween. The structure (holding capacitor) (Cs) 32 is disposed in parallel with the liquid crystal capacitor (Clc) 31. In the case where the storage capacitor electrode 30 has a large area, a resultant aperture or opening rate is decreased. In such a case, the storage capacitor electrode 30 is formed of a transparent conductor film (e.g., ITO film).

On the TFT 94 and the pixel electrode 95 of the active matrix substrate 20, an alignment film 43*a* for controlling an alignment state of the liquid crystal 49 is present. The alignment film 43*a* is subjected to a uniaxial aligning treatment (e.g., rubbing).

On the other hand, the opposing substrate 40 includes a substrate (e.g., glass substrate) 41; a common electrode 42 having a uniform thickness disposed on the entire substrate 41; and an alignment film 43*b* having a uniform thickness, disposed on the common electrode 42, for controlling an alignment state of the liquid crystal 49.

The above panel (cell) structure (liquid crystal device) including a plurality of the pixels, each having the structure shown in FIG. 12, is sandwiched between a pair of cross-nicol polarizers (not shown) with polarizing axes intersecting each other at right angles.

The liquid crystal material constituting the liquid crystal layer 49 may preferably be a chiral smectic liquid crystal (composition) which has a spontaneous polarization and exhibits the above-mentioned alignment state (or switching behavior) shown in FIGS. 6AA–6D and V-T (optical response) characteristic shown in FIG. 7.

Next, an example of an ordinary active matrix driving method according to the present invention utilizing the liquid crystal device using the active matrix substrate (plate) and a chiral smectic liquid crystal having the characteristics as described above will be described with reference to FIGS. 13 and 14 in combination with FIGS. 11 and 12.

Figure 13:
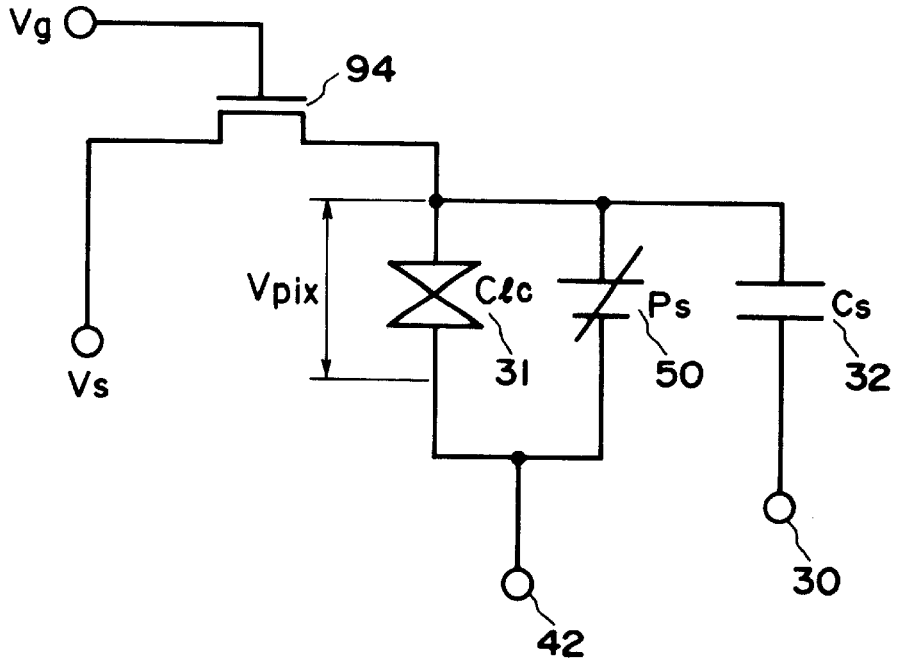
FIG. 13 shows an equivalent circuit of each pixel portion shown in FIG. 12.
Figure 14:
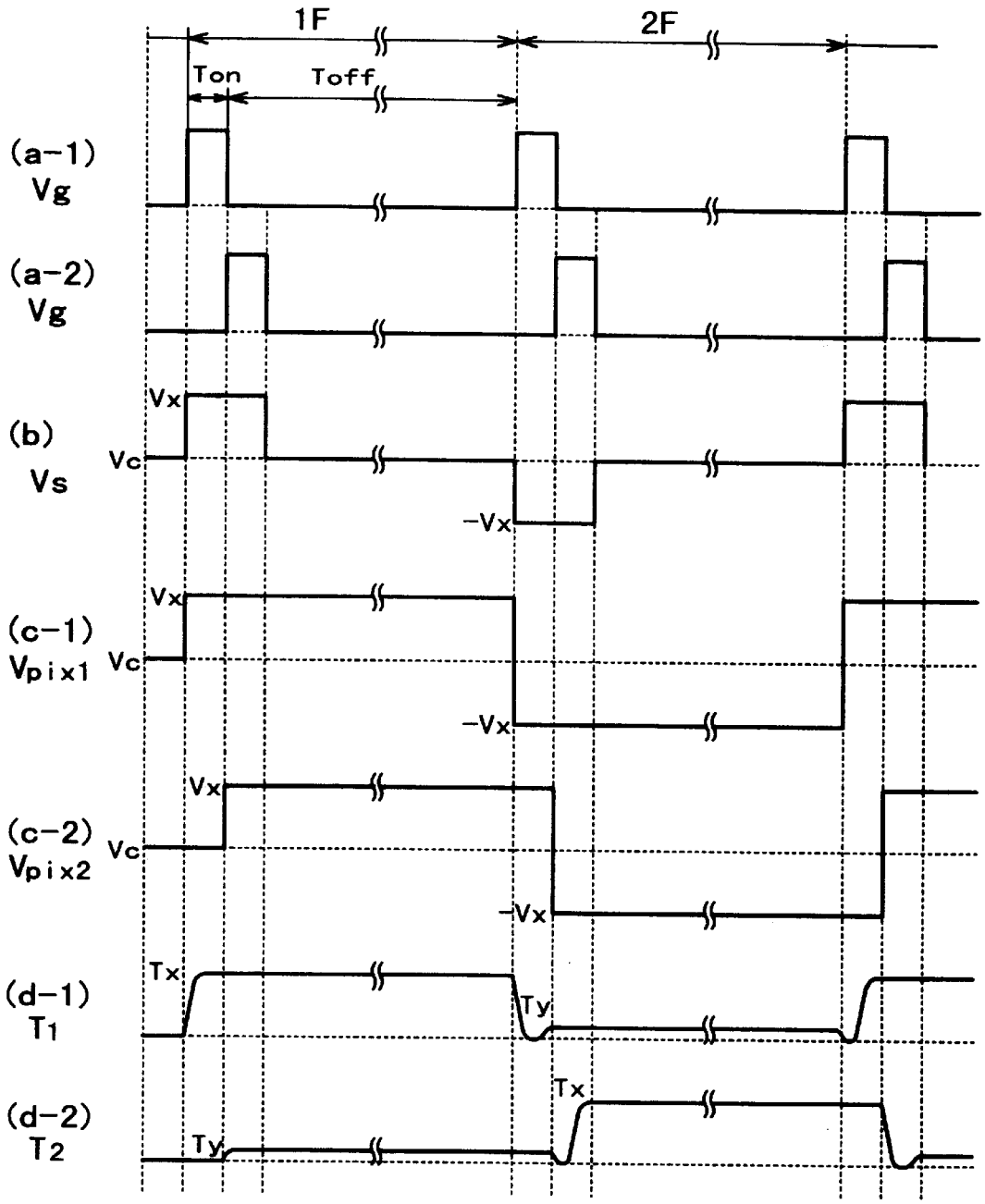
FIG. 14 shows drive waveform diagrams (at (a-1), (a-2), (b), (c-1) and (c-2)) for driving the active matrix-type liquid crystal device shown in FIG. 11 and corresponding transmitted light quantities (at (d-1) and (d-2)).

FIG. 13 shows an example of an equivalent circuit for each pixel portion of such a liquid crystal device shown in FIG. 12, and FIG. 14 shows an embodiment of a driving waveform.

In the active matrix driving method according to the present invention described below, the liquid crystal layer is supplied with voltages of different polarities alternately changed for each frame period. FIG. 14 is a driving waveform applied to two adjacent pixels connected with the same source line.

FIG. 14 shows at (a-1) and (a-2) voltage waveforms applied to two gate lines (e.g., G1 and G2 shown in FIG. 11) (as scanning lines) connected with two adjacent pixels, respectively, which are connected with the same source line (e.g., S1).

In the liquid crystal device driven by the active matrix driving method, the gate lines G1, G2, . . . shown in FIG. 11 are selected in a line-sequential manner in each frame (1F, 2F) period. At this time, each gate electrode 22 (as shown in FIG. 12) connected with a corresponding gate line is supplied with a prescribed gate voltage Vg in a selection period $T_{on}$ of each frame period (e.g., 1F), thus placing the TFT 94 in an "ON" state. In a non-selection period $T_{off}$ (of, e.g., 1F) corresponding to a period in which other gate lines are selected, the gate electrode 22 is not supplied with the gate voltage Vg, thus placing the TFT 94 in an "OFF" state (high resistance state).

FIG. 14 shows at (b) a voltage waveform applied to the source line (e.g., S1 shown in FIG. 11) (as a data signal line) connected to the two pixels concerned.

When the gate electrode 22 is supplied with the gate voltage Vg in the selection period $T_{on}$ of each frame period 1F or 2F as shown at (a-1) or (a-2) of FIG. 14, in synchronism with this voltage application, a prescribed source voltage (data signal voltage) Vs having a prescribed potential providing a writing data (pulse) to the pixels concerned is applied to a source electrode 27 through the source line connected with the pixels based on a potential Vc of a common electrode 42 as a reference potential.

More specifically, in each frame period (1F or 2F), a positive or negative polarity source voltage Vs having a potential Vx or −Vx (=V) (based on a reference potential Vc) providing a desired optical state or display data (transmittance) based on the V-T characteristic as shown in FIG. 7 is applied to the liquid crystal at the pixel concerned.

At this time, at a pixel where the TFT 94 is in an "ON" state, the positive or negative polarity source voltage Vx or −Vx applied to the source electrode 27 is supplied to a pixel electrode 95 via a drain electrode 28, thus charging a liquid crystal capacitor (Clc) 31 and a holding (storage) capacitor (Cs) 32. As a result, the potential of the pixel electrode 95 becomes a level equal to that of the positive or negative polarity source (data signal) voltage Vx or −Vx.

Then, in a subsequent non-selection period $T_{off}$, for the gate line on the pixel concerned, the TFT 94 is in an "OFF" (high resistance) state. At this time (in $T_{off}$ of 1F or 2F), in the liquid crystal cell, the liquid crystal capacitor (Clc) 31 and the holding capacitor (Cs) 32 retain the electric charges therein, respectively, charged in the selection period $T_{on}$ to keep the (positive or negative polarity) voltage Vx or −Vx. As a result, the liquid crystal layer 49 of the pixel concerned is supplied with the voltage Vx or −Vx through one frame period 1F or 2F to provide thereat a desired optical state (transmitted light quantity) depending on the voltage Vx or −Vx.

FIG. 14 shows at (c-1) and (c-2) waveforms of pixel voltages Vpix1 (for the first domain D1) and Vpix2 (for the second domain D2), each actually held by the liquid crystal capacitor (Clc) 31 and the holding capacitor (Cs) 32 of the pixel concerned and applied to the liquid crystal layer 49, and FIG. 14 shows at each of (d-1) and (d-2) an example of an actual optical response (in the case of a liquid crystal device of a transmission-type) at the pixel concerned (d-1) for the domain D1 and (d-2) for the domain D2).

In the present invention, transmittance varies depending on the polarity of an applied voltage in the first and the second domains D1 and D2, which are opposite to each other. Specifically, in the first domain D1, in the frame period 1F under application of the positive polarity voltage Vx, a gradational display state (transmitted light quantity Tx) is obtained depending on Vx, based on the V-T characteristic as shown in FIG. 7. Further, in the negative polarity voltage (−Vx) application frame (e.g., 2F), based on the V-T characteristic as shown in FIG. 7, only a lower transmitted light quantity (considerably smaller than Tx), thus resulting in Ty closer to zero (but a non-zero value).

On the other hand, in the second domain D2, opposite to those in the first domain D1, a gradational display state depending on −Vx is obtained in the negative-polarity voltage application period and a lower-transmitted light quantity Ty closer to zero is obtained in the positive-polarity voltage (Vx) application period.

As described above, in the frame period, it is possible to substantially effect display of a transmitted light quantity level closer to zero for each scanning (gate) in each frame period, thus attaining a display state substantially identical to that in the case of effecting 1H inversion driving.

Second Embodiment

Figure 16:
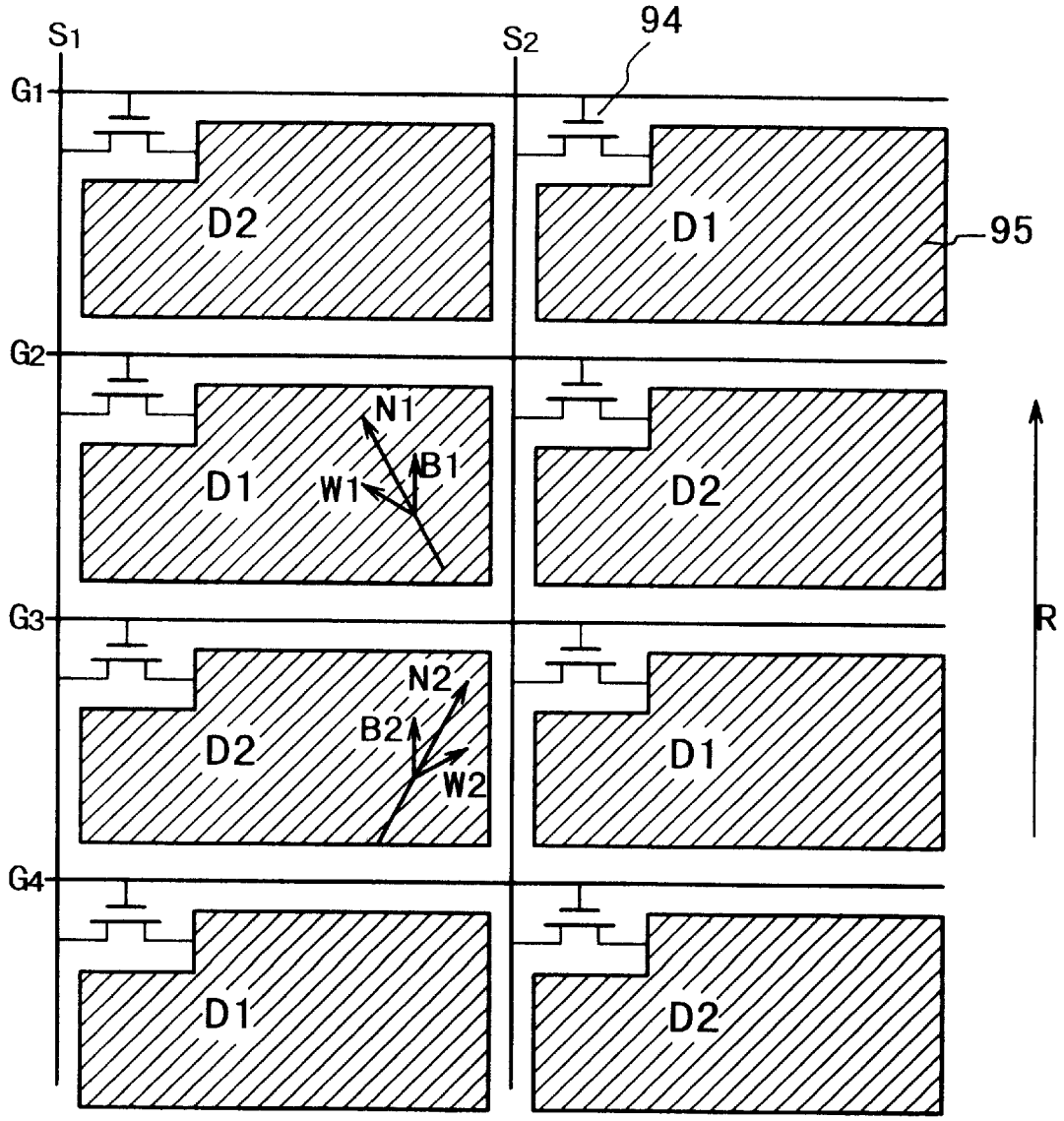

In this embodiment, an active matrix-type liquid crystal device has a cell structure identical to that of the liquid crystal device used in the above-described First Embodiment except for employing such an arrangement of first and second domains D1 and D2 that a first domain D1 at a pixel is adjacent to a second domain at any adjacent pixel in the gate line direction and the source line direction, thus providing a plurality of pixels including any adjacent two pixels providing different domains D1 and D2 as shown in FIG. 16. This arrangement may be modified so that a pixel block (group) comprising plural pixels providing one domain (e.g., D1) is adjacent to another pixel block comprising plural pixels providing the other domain (e.g., D2) in the gate and source line directions, respectively.

In the present invention, the chiral smectic liquid crystal used in the liquid crystal device generally exhibits the birefringence effect, thus providing a contrast between dark and bright states. When a transmission-type liquid crystal device is used as the liquid crystal device of the present invention, the liquid crystal device is sandwiched between a pair of cross-nicol polarizers so that one of the polarizing axes (directions) of the polarizers is aligned with an optical axis direction of the liquid crystal (device), thus realizing a darkest state. A bright state is generally controlled by appropriately adjusting the optical direction of the liquid crystal (device) based on the magnitude of an applied voltage, thus causing the birefringence effect.

In the case where a chiral smectic (ferroelectric) liquid crystal device using a chiral smectic liquid crystal providing 2Ⓗ of 45 degrees is sandwiched between the pair of cross-nicol polarizers, the darkest state is given by aligning the optical axis direction in one stable state S1 with either one of the polarizing directions of the two polarizers. In order to place the other stable state S2 in a white (bright) state based on the birefringence effect, a retardation $\Delta nd$ ($\Delta n$: refractive index anisotropy, d: cell gap or liquid crystal layer thickness) may generally be set to $\lambda/2$ ($\lambda$: a wavelength of visible light). When $\lambda$=550 nm ($\Delta nd$=275 nm) is set for the liquid crystal device and the liquid crystal device is viewed from a direction providing a polar angle $\theta$ of 45 deg. (polar angle $\theta$=0 deg. in the direction normal to the substrate), i.e., viewed from the circular base of the virtual cone, a retardation in the bright state largely depends on a direction of a bearing angle (azimuth) $\theta$. This is attributable to different retardations (optical path difference) between a retardation in a long molecular axis direction and a retardation in a short molecular axis direction when the liquid crystal device is observed from its oblique direction, since a bright state is given by light transmission based on the birefringence effect as described above. When a viewing angle is closer to the long axis direction of liquid crystal molecules, a resultant refractive index anisotropy (birefringence) is liable to change compared with the case where the viewing angle is in other directions, thus being liable to change or invert a gradational level and color tone in the long molecular axis direction. On the other hand, in the short molecular axis direction perpendicular to the long molecular axis direction, the resultant refractive index anisotropy is not changed, but the optical path is increased with a tilting (inclination) of the viewing angle. As a result, white color tone is shifted toward a yellowish tint in the short molecular axis direction.

In order to prevent such a yellowish tint phenomenon, in this embodiment, the liquid crystal device shown in FIG. 16 employs the above-mentioned arrangement of the first and second domains D1 and D2 different in layer normal direction of liquid crystal molecules such that the domains D1 and D2 for each pixel (or pixel group or unit consisting of two or more adjacent pixels) are arranged so that adjacent two pixels (or pixel groups) providing the domains D1 and D2 are different from each other in the layer normal direction. When the liquid crystal molecules assume a dark (black) state at a molecular position B1 in the domain D1 and another dark state at a molecular position B2 in the domain D2, the dark molecular position B1 corresponds to a position rotated clockwise from a layer normal direction N1 (in the domain D1) and the other dark molecular position B2 corresponds to a position rotated counterclockwise from a layer normal direction N2 (in the domain D2). In this instance, the average molecular axes at the dark molecular positions B1 and B2 are respectively somewhat deviated from a uniaxial aligning treatment axis direction (rubbing direction) R (FIG. 16). Under application of a voltage, a bright (white) molecular position W1 in the domain D1 is present at a position rotated counterclockwise from the dark molecular position B1 and another bright molecular position W2 in the domain D2 is present at a position rotated clockwise from the dark molecular position B2 (FIG. 16).

When the bright state at the molecular position W1 is viewed from an oblique direction corresponding to the long molecular axis direction, another bright state at the molecular position W2 is consequently viewed substantially from the short molecular axis direction, thus compensating for each other's change in retardation. As a result, the resultant while color tone (tint) does not change with viewing angle.

In this embodiment, the first and second domains D1 and D2 different in layer normal direction (N1, N2) may preferably be formed through the treating methods (1)–(3).

(1) During a phase transition from Ch to SmC* or from Iso. to SmC*, DC (direct current) voltages of different polarities for each domain (e.g., a positive polarity for D1 and a negative polarity for D2) are applied between a pair of substrates.

(2) A pair of substrates is provided with alignment films different in material for the domains D1 and D2, respectively.

(3) A pair of substrates, each provided with an alignment film, is subjected to different treating methods for the domains D1 and D2 in terms of, e.g., film-forming conditions, rubbing strength, and UV irradiation conditions.

As described above, in the liquid crystal device wherein the chiral smectic liquid crystal is sandwiched between a pair of substrates each provided with an electrode and at least one of which is provided with active elements each at each of the pixels so that the liquid crystal molecules are tilted continuously from an average molecular axis direction (in which the liquid crystal molecules are mono-stabilized) depending on magnitude of a voltage applied thereto, it is possible to effect an analog-like gradation display while suppressing an occurrence of the yellowish tilt phenomenon observed from the oblique direction by providing different layer normal directions (N1 and N2) for any adjacent two domains D1 and D2 (corr. to adjacent two pixels or pixel groups or blocks).

In the case where a liquid crystal device is driven in a line-sequential manner according to an inversion driving scheme such that each (one) frame period is divided into two (first and second) field periods and a first polarity voltage (electric field) is applied to the entire liquid crystal panel in the first field period and a second polarity voltage is applied to the entire liquid crystal panel in the (subsequent) second field period, the liquid crystal molecules are largely tilted in the domain D1 in the first field period under the first polarity voltage application, but slightly tilted in the domain D2. On the other hand, in the subsequent second field period under application of the second polarity voltage, the liquid crystal molecules are slightly tilted in the domain D1, but largely tilted in the domain D2. As a result, in either field period (first or second field period), the liquid crystal molecules provide a bright display state as a whole since those in either one of the domains D1 and D2 are largely tilted in each field period, thus failing to obtain good motion picture image qualities, since the resultant image is not formed through a high (first) luminance display field period and a low (second) luminance display field period constituting each frame period.

In this embodiment, the liquid crystal device (panel) is supplied with a voltage (electric field) so that a positive polarity voltage for, e.g., the first domain D1 and a negative polarity voltage for, e.g., the second domain D2 are alternately applied to the pixels for each field period. Specifically, in the first field period, the domains D1 are supplied with the positive (first) polarity voltage and the domains D2 are supplied with the negative (second) polarity voltage. In the subsequent second field period, the domains D1 are supplied with the negative (second) polarity voltage and the domains D2 are supplied with the positive (first) polarity voltage. At that time, in the first field period, the liquid crystal molecules in all the domains D1 and D2 are largely tilted to provide a high luminance display state, since those in the domains D1 and D2 are supplied with the positive (first) and negative (second) polarity voltages, respectively. In the subsequent second field periods, the liquid crystal molecules in all the domains D1 and D2 are slightly tilted to provide a low luminance display state, since those in the domains D1 and D2 are supplied with the negative (second) polarity voltage and the positive (first) polarity voltage, respectively. As a result, in each frame period comprising the first and second field periods, the high luminance display state in the first field period and a low luminance display state in the second field period can be attained, thus obtaining good motion picture image qualities while retaining a good viewing angle characteristic over the entire liquid crystal panel.

Hereinbelow, the present invention will be described more specifically based on examples.

EXAMPLE 1

Blank Cell A

A blank cell A was prepared in the following manner.

A pair of 1.1 mm-thick glass substrates, each provided with a 700 Å-thick transparent electrode of ITO film, was provided.

On each of the transparent electrodes (of the pair of glass substrates), a polyimide precursor for forming a polyimide having a recurring unit (PI-a) shown below was applied by spin coating and pre-dried at 80° C. for 5 minutes, followed by hot-baking at 200° C. for 1 hour to obtain a 200 Å-thick polyimide film.

(PI-a)

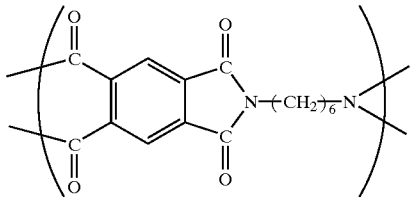

Each of the thus-obtained polyimide films was subjected to rubbing treatment (as a uniaxial aligning treatment) with a nylon cloth under the following conditions to provide an alignment control film.

Rubbing roller: a 10 cm-diameter roller about which a nylon cloth ("NF-77", mfd. by Teijin K.K.) was wound Pressing depth: 0.3 mm Substrate feed rate: 10 cm/sec Rotation speed: 1000 rpm Substrate feed: 4 times Then, on one of the substrates, silica beads (average particle size=2.0 $\mu$m) were dispersed and the pair of substrates were applied to each other so that the rubbing treating axes were in parallel with each other but oppositely directed (anti-parallel relationship), thus preparing a blank cell (single-pixel cell) A with a uniform cell gap.

Black Cell B

A blank cell B was prepared in the same manner as in the case of the blank cell A except that one of the pair of glass substrate was formed in an active matrix substrate provided with a plurality of a-Si TFTs and a silicone nitride (gate insulating) film and the other glass substrate was provided with a color filter including color filter segments of red (R), green (G) and blue (B). For each TFT, a holding capacitance (Cs) was set to a value which was five times that of a liquid crystal capacitance (Clc).

The thus prepared blank cell (active matrix cell) B, having a structure as shown in FIG. 12, had a picture area size of 10.4 inches including a multiplicity of pixels (800×600×RGB).

Liquid Crystal Devices A and B

A liquid crystal composition LC-1 was prepared by blending the following mesomorphic (liquid crystal) compounds in the indicated proportions.

| Structural formula | wt. parts |
|---|---|
| 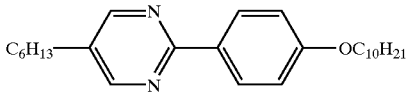 | 17 |
| 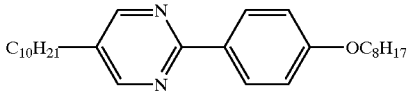 | 17 |
| 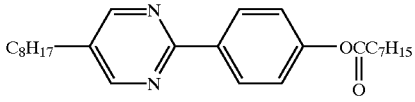 | 11.3 |

-continued

| Structural formula | wt. parts |
|---|---|
| 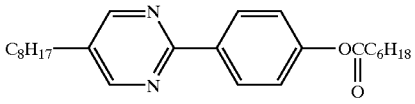 | 11.3 |
| 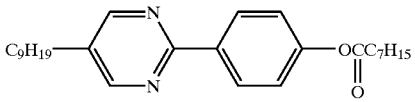 | 11.3 |
| 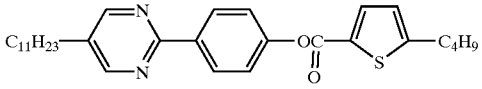 | 30 |
| 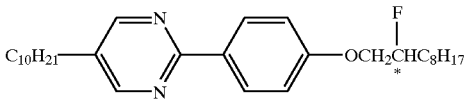 | 2 |

The thus-prepared liquid crystal composition LC-1 showed the following phase transition series and physical properties.

Phase transition temperature (°C.)

$$\text{Iso} \xrightarrow{67.0} \text{Ch} \xrightarrow{50.6} \text{SmC}^* \xrightarrow{-9.3} \text{Cry}$$

(Iso: isotropic phase, Ch: cholesteric phase, SmC*: chiral smectic phase)

Spontaneous polarization (Ps): 1.2 nC/cm$^2$ (30° C.)

Cone angle Ⓗ: 24.1 degrees (30° C.)

Helical pitch (SmC*): at least 20 $\mu$m (30° C.)

The liquid crystal composition LC-1 was injected into each of the above-prepared blank cells A and B in its isotropic liquid state and gradually cooled to a temperature providing chiral smectic C phase to prepare a (single-pixel) liquid crystal device A and a (active matrix) liquid crystal device B, respectively.

In the above cooling step from Iso to SmC*, each of the cells (devices) A and B was subjected to a voltage application treatment such that a DC (offset) voltage of −5 volts was applied in a temperature range of Tc±2° C. (Tc: Ch−SmC* phase transition temperature) while cooling each device at a rate of 1° C./minute.

Further, with respect to another liquid crystal device prepared in the same manner as in the liquid crystal device B, the following voltage application treatment for the pixels was undertaken.

The pixels (m×n pixels, wherein m was the number of gate line (m=1–800) and n was the number of source line (n=1–600)) were divided into a first pixel group comprising the pixels having an even-numbered m (m=2, 4, 6 . . . ) and a second pixel group comprising the pixels having an odd-numbered m (m=1, 3, 5, . . . ).

A DC (offset) voltage of +5 V was applied the first pixel group (m=2, 4, 6, . . . ) and a DC voltage of −5 V was applied to the second pixel group (m=1, 3, 5, . . . ), respectively, in the same manner as liquid crystal devices A and B.

The thus-prepared liquid crystal devices A, B and C were evaluated in the following manner in terms of alignment state and optical response characteristics for triangular wave and rectangular wave, and flickering-prevention characteristic, respectively.

Alignment State

The alignment state of the liquid crystal composition LC-1 in each of the liquid crystal devices A and C was observed through a polarizing microscope at 30° C. (room temperature).

As a result, in the liquid crystal device A, a substantially uniform alignment state such that under no voltage application, the darkest (optical) axis was somewhat deviated from the rubbing direction and only one layer normal direction was present over the entire cell was observed.

In the liquid crystal device C, a substantially uniform alignment state such that under no voltage application, the darkest (optical) axis deviated somewhat from the rubbing direction and the layer normal directions were aligned in only one direction in domains for pixels on the same (one) gate line, but were different from each other with respect to adjacent two gate lines (e.g., G1 and G2 shown in FIG. 15), was observed.

Optical Response to Triangular Wave

The liquid crystal device A was set in a polarizing microscope equipped with a photomultiplier under cross nicol relationship so that a polarizing axis was disposed to provide the darkest state under no voltage application.

When the liquid crystal device A was supplied with a triangular wave (±5 volts, 0.2 Hz) at 30° C., a resultant transmitted light quantity (transmittance) was gradually increased with the magnitude (absolute value) of the applied voltage under application of the positive polarity voltage. On the other hand, under application of the negative polarity voltage, a resultant transmitted light quantity was changed with the applied voltage level, but a maximum value of the transmittance was ca. 1/10 of a maximum transmittance in the case of the positive polarity voltage application.

Optical Response to Rectangular Wave

The optical response for the liquid crystal device A was evaluated in the same manner as above when using the triangular wave except a rectangular wave (±5 volts, 60 Hz) was used instead.

As a result, under application of the positive polarity voltage, the liquid crystal composition LC-1 was found to exhibit a sufficient optical response thereto and provide a stable intermediate (halftone) state independent of a previous state. Further, also under application of the negative polarity voltage, an optical response (in terms of transmittance) was confirmed similar to the positive polarity application, but the value thereof was ca. 1/10 of that in the case of the positive polarity voltage application when compared at an identical absolute value of the voltages. It was also confirmed that an average value of the resultant transmittance did not depend on that in their previous states, thus attaining a good halftone image display.

Flickering-Prevention Characteristic

Each of the active matrix-type liquid crystal devices B and C was driven according to the frame inversion driving scheme with or without effecting the 1H inversion driving (wherein the polarity of the applied voltage was changed in one horizontal scan period for each gate line).

In the case of the liquid crystal device B driven by the frame inversion driving scheme without effecting the 1H inversion driving, a remarkable flickering phenomenon was observed.

In the case of the liquid crystal device B driven by the frame inversion driving scheme while effecting the 1H inversion driving, the flickering phenomenon was not observed, but a halftone color reproducibility was poor, thus failing to provide a clear display image.

On the other hand, in the case of the liquid crystal device C driven by the frame inversion driving scheme without effecting the 1H inversion driving, no flickering phenomenon was observed. Further, a good halftone color reproducibility was attained, thus providing a clear display image.

EXAMPLE 2

Liquid crystal devices D, E and F were prepared in the same manner as liquid crystal devices A, B and C of Example 1, respectively, except that the voltage application treatment for the liquid crystal device F (as shown in FIG. 1A) was performed in the following manner.

The pixels (m×n pixels, wherein m was the number of gate line (m=1–800) and n was the number of source line (n=1–600)) were divided into a first pixel group comprising the pixels having an even-numbered m+n (m+n=2, 4, 6 . . . ) and a second pixel group comprising the pixels having an odd-numbered m+n (m+n=1, 3, 5, . . . ).

A DC (offset) voltage of +5 V was applied to the first pixel group (m=2, 4, 6, . . . ) and a DC voltage of −5 V was applied to the second pixel group (m=1, 3, 5, . . . ), respectively, in the same manner as the liquid crystal devices A and B.

The thus-prepared liquid crystal devices D, E and F were evaluated in the following manner in terms of alignment state, optical response characteristics for triangular wave and rectangular wave, viewing angle characteristic, and upstream picture image display characteristic, respectively.

Alignment State

The alignment state of the liquid crystal composition LC-1 in each of the liquid crystal devices D and F was observed through a polarizing microscope at 30° C. (room temperature).

As a result, in the liquid crystal device D, a substantially uniform alignment state such that under no voltage application, the darkest (optical) axis deviated somewhat from the rubbing direction and only one layer normal direction was present over the entire cell was observed.

In the liquid crystal device F, a substantially uniform alignment state such that under no voltage application, the darkest (optical) axis deviated somewhat from the rubbing direction and the layer normal directions were aligned in only one direction in domains for pixels on the same (one) gate line, but were different from each other with respect to adjacent two gate lines (e.g., G1 and G2 shown in FIG. 15), was observed.

Optical Response to Triangular Wave

The liquid crystal device D was set in a polarizing microscope equipped with a photomultiplier under cross nicol relationship so that a polarizing axis was disposed to provide the darkest state under no voltage application.

When the liquid crystal device D was supplied with a triangular wave (±5 volts, 0.2 Hz) at 30° C., a resultant transmitted light quantity (transmittance) was gradually increased with the magnitude (absolute value) of the applied voltage under application of the positive polarity voltage. On the other hand, under application of the negative polarity voltage, a resultant transmitted light quantity was changed with the applied voltage level but a maximum value of the transmittance was ca. 1/10 of a maximum transmittance in the case of the positive polarity voltage application.

Optical Response to Rectangular Wave

The optical response for the liquid crystal device D was evaluated in the same manner as above when using the triangular wave except a rectangular wave (±5 volts, 60 Hz) was used instead.

As a result, under application of the positive polarity voltage, the liquid crystal composition LC-1 was found to exhibit a sufficient optical response thereto and provide a stable intermediate (halftone) state independent of a previous state. Further, also under application of the negative polarity voltage, an optical response (in terms of transmittance) was confirmed similarly to the positive polarity application, but the value thereof was ca. 1/10 of that in the case of the positive polarity voltage application when compared at an identical absolute value of the voltages. It was also confirmed that an average value of the resultant transmittance did not depend on that in their previous states, thus attaining a good halftone image display.

Viewing Angle Characteristic

When the liquid crystal device E was placed in a white display state over the entire display panel, the liquid crystal device E showed a wavelength-dependent viewing angle characteristic such that display images showed a bluish tint and a yellowish tint depending on viewing angles.

As a result, the resultant transmitted light was found to vary depending on the wavelengths different with a changing viewing angle.

On the other hand, when the liquid crystal device F was driven by the frame inversion driving scheme, a positive polarity voltage (electric field) was applied to the entire liquid crystal panel in even-number frame periods and a negative-polarity voltage was applied to the entire liquid crystal panel in odd-number frame periods.

As a result, when the entire liquid crystal panel was placed in a white display state, it was possible to realize a white display performance with no change in color tone irrespective of the viewing angles.

Further, the liquid crystal device F (having m×n pixels) was driven by a dot inversion driving scheme such that each frame period was divided into a first field period and a second field period and the pixels (domains) having the even-numbered m+n (m+n=2, 4, 6, . . . ) were supplied with a positive polarity voltage (electric field) and those having the odd-numbered m+n (m+n=3, 5, 7, . . . ) were supplied with a negative polarity voltage in a first field period, and in a second field period, the even-numbered m+n pixels were supplied with the negative polarity voltage and the odd-numbered m+n pixels were supplied with the positive polarity voltage.

As a result, when the entire liquid crystal panel was placed in a white display state, it was possible to realize a white display performance with no change in color tone irrespective of the viewing angles.

Motion Picture Image Display

The liquid crystal device F was driven according to the above-mentioned frame inversion driving scheme to evaluate a motion picture quality in the following manner.

Three images (flesh-colored chart, sightseeing information (guide) board, and yacht basin) were selected from Hi-vision standard images (still images) of BTA (Broadcasting Technology Association) and respective central portions (each corr. to 432×168 pixels) of these images were used as three sample images.

These sample images were moved at a speed of 6.8 (deg/sec) corresponding to that of an ordinary TV program to form motion picture images, to evaluate a degree of image blur particularly at a peripheral portion of the outputted images.

Specifically, evaluation of the images was performed by 10 amateur viewers in accordance with the following evaluation standard.

5: Clear and good motion picture image with no peripheral image blur was observed.

4: Slight peripheral image blur was observed but was practically of no negative impact.

3: Peripheral image blue was observed, and it was difficult to recognize fine or small characters.

2: Remarkable peripheral image blur was observed, and it was difficult to recognize large characters.

1: Remarkable image blue was observed over the entire picture area, and the original sample images were barely recognized.

As a result, a slight peripheral image blur of the motion picture images was observed, but was at a practically fully acceptable level between ca. "3" and "4".

Then, the liquid crystal device F was driven according to the above-mentioned dot inversion driving scheme.

As a result, excellent motion picture images with no peripheral image blur were observed at a level of "5".

As described hereinabove, according to the present invention, it is possible to provide a liquid crystal device using a chiral smectic liquid crystal capable of allowing high speed responsiveness and control of gradation levels, while retaining excellent motion picture image qualities and a good viewing angle characteristic and providing clear images with no flickering phenomenon.

What is claimed is:

1. A liquid crystal device, comprising:

a chiral smectic liquid crystal, a pair of substrates disposed to sandwich the liquid crystal and having thereon electrodes for applying a voltage to the liquid crystal so as to form a plurality of pixels each provided with an active element connected to an associated electrode on at least one of the substrate, wherein the liquid crystal is aligned to form domains D1 and D2 having mutually different directions of normal to smectic layers, and the liquid crystal has an alignment characteristic in each of the domains D1 and D2 such that the liquid crystal is aligned to provide an average molecular axis to be placed in a monostable alignment state under no voltage application, is tilted from the monostable alignment state in one direction when supplied with a voltage of a first polarity at a tilting angle which varies depending on magnitude of the supplied voltage, and is tilted from the monostable alignment state in the other direction when supplied with a voltage of a second polarity opposite to the first polarity at a tilting angle, said tilting angles providing maximum tilting angles $\beta 1$ and $\beta 2$ formed under application of the voltages of the first and second polarities, respectively, satisfying:

$$\beta 1 > \beta 2 > 0 \text{ in the domain } D1,$$

and $$0 < \beta 1 < \beta 2 \text{ in the domain } D2.$$

2. A device according to claim 1, wherein each of said domains D1 and D2 is present at each pixel so that a domain D1 at a pixel and a domain D2 at an adjacent pixel are alternately present over all the pixels.

3. A device according to claim 1, wherein the pixels are divided into a plurality of first pixel groups and second pixel groups each disposed adjacent to a corresponding first pixel group, each of said domains D1 and D2 are present at a first pixel group and a second pixel group, respectively.

4. A device according to claim 1, wherein the maximum tilting angles $\beta 1$ and $\beta 2$ satisfy $\beta 1 \geqq 5 \times \beta 2$ in the domain D1 and $\beta 1 \leqq (1/5) \times \beta 2$ in the domain D2.

5. A device according to claim 4, wherein the liquid crystal shows a phase transition series on temperature decrease including isotropic liquid phase (Iso), cholesteric phase (Ch) and chiral smectic C phase (SmC*) or isotropic liquid phase (Iso) and chiral smectic C phase (SmC*), and has an alignment characteristic such that smectic liquid crystal molecules are placed in an alignment state comprising two domains D1 and D2 wherein layer normal directions of the smectic liquid crystal molecules in the domains D1 and D2, respectively, are each aligned substantially in one direction but the layer normal direction in the domain D1 is different from that in the domain D2.

6. A device according to claim 5, wherein the liquid crystal has a helical pitch in its bulk state larger than a value two times a cell thickness.

7. A device according to claim 1, wherein the pixels are connected with gate lines and source lines and the domains D1 and D2 are present at pixels along adjacent two gate lines, respectively.

8. A device according to claim 7, wherein the liquid crystal has a voltage-transmittance characteristic such that the liquid crystal at each pixel provides a first transmittance in each of the domains D1 and D2 under no voltage application, a second transmittance in each of the domains D1 and D2 under application of a voltage of a first polarity, and a third transmittance in each of the domains D1 and D2 under application of a voltage of a second polarity, and a transmittance varying continuously depending on magnitude of the applied voltage between the first and second transmittances in the domain D1 or between the first and third transmittances in the domain D2.

9. A device according to claim 8, wherein the first transmittance corresponds to a minimum transmittance in the device, and the second transmittance in the domain D1 or the third transmittance in the domain D2 corresponds to a maximum transmittance in the device.

10. A liquid crystal apparatus, comprising:

a liquid crystal device according to claim 1, and drive means for driving the liquid crystal device according to an active matrix driving scheme to effect an analog gradational display.

11. An apparatus according to claim 10, wherein an image signal comprising a positive electric field and a negative electric field is applied to an image signal line so that the domain D1 is supplied with the positive electric field and the domain D2 is supplied with the negative electric field.

* * * * *

UNITED STATES PATENT AND TRADEMARK OFFICE

CERTIFICATE OF CORRECTION

PATENT NO. : 6,577,289 B1
DATED : June 10, 2003
INVENTOR(S) : Yasufumi Asao et al.

It is certified that error appears in the above-identified patent and that said Letters Patent is hereby corrected as shown below:

Column 5,
Line 58, "t" should read -- to --.

Column 18,
Line 22, "angle a", should read -- angle α --.

Column 26,
Line 32, "substrate" should read -- substrates --.

Column 27,

Line 6, " 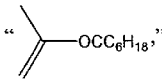 " should read -- 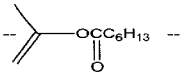 --

Column 31,
Line 5, "blue" should read -- blur --; and
Line 29, "substrate," should read -- substrates, --.

Signed and Sealed this

Twenty-fourth Day of August, 2004

JON W. DUDAS
*Director of the United States Patent and Trademark Office*